US011386875B2

(12) United States Patent
Greenebaum et al.

(10) Patent No.: US 11,386,875 B2
(45) Date of Patent: Jul. 12, 2022

(54) AUTOMATIC DISPLAY ADAPTATION BASED ON ENVIRONMENTAL CONDITIONS

(71) Applicant: Apple Inc., Cupertino, CA (US)

(72) Inventors: Kenneth I. Greenebaum, San Carlos, CA (US); Travis W. Brown, San Jose, CA (US); Ian C. Hendry, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/887,621

(22) Filed: May 29, 2020

(65) Prior Publication Data

US 2020/0380938 A1 Dec. 3, 2020

Related U.S. Application Data

(60) Provisional application No. 62/855,714, filed on May 31, 2019.

(51) Int. Cl.

| | |
|---|---|
| ***G09G 3/20*** | (2006.01) |
| ***G09G 5/393*** | (2006.01) |
| ***G09G 5/06*** | (2006.01) |

(52) U.S. Cl.

CPC ..... *G09G 5/393* (2013.01); *G09G 3/2003* (2013.01); *G09G 5/06* (2013.01); *G09G 2320/0666* (2013.01); *G09G 2360/141* (2013.01); *G09G 2360/144* (2013.01)

(58) Field of Classification Search

CPC ..... G09G 5/393; G09G 3/2003; G09G 5/06; G09G 2320/0666; G09G 2360/141; G09G 2360/144

See application file for complete search history.

(56) References Cited

U.S. PATENT DOCUMENTS

| | | | | |
|---|---|---|---|---|
| 2012/0081279 | A1* | 4/2012 | Greenebaum | G09G 5/02 345/156 |
| 2016/0142714 | A1* | 5/2016 | Toma | H04N 19/85 375/240.25 |
| 2020/0013151 | A1* | 1/2020 | Atkins | G06T 5/009 |

* cited by examiner

*Primary Examiner* — Robert J Michaud

(74) *Attorney, Agent, or Firm* — Blank Rome LLP

(57) ABSTRACT

A device comprises memory, a display characterized by a characteristic, and processors coupled to the memory. The processors receive data indicative of a preferred adaptation technique and intended display parameter. The processors adapt the content item to a display color space and the intended display parameter based on the preferred adaptation technique. The processors modify the intended display parameter based at least in part on the display characteristic to obtain a modified display parameter and cause the adapted content item to be displayed on the display according to the modified display parameter. In some embodiments, the processors obtain data indicative of ambient light conditions and adjust the modified display parameter based on the data indicative of ambient light conditions. In some embodiments, the processors cause the adapted content item to be displayed according to the adjusted and modified display parameter.

41 Claims, 10 Drawing Sheets

AUTOMATIC DISPLAY ADAPTATION BASED ON ENVIRONMENTAL CONDITIONS

BACKGROUND

Today, consumer electronic devices with display screens are used in many different environments with many different lighting conditions, e.g., the office, the home, home theaters, inside head-mounted displays (HMD), and outdoors. Devices typically need to be designed so that no matter what the user's viewing environment is at any given moment, minimal (or, ideally, no) color banding is perceivable to the viewer, and displayed content has consistent appearance and tonality. Many content items are authored for particular display devices and viewing environments. For example, movies are often authored for rec.709 displays in dark viewing environments. Devices typically need to be able to adapt content items to many different types of intended display devices and many different suggested viewing environments, such that the content items appear as the content authors intended they be perceived no matter what the user's current viewing environment is.

For these reasons and more, it is desirable to adapt each content item to its suggested viewing environment, then from its suggested viewing environment to a shared, system-level viewing environment, and from the shared, system-level viewing environment to the current viewing environment. Thus, there is a need for techniques to implement an "environmentally-aware" system that is capable of utilizing an ambient conditions model to automatically adjust a display's overall content adaptation process, e.g., to counter the influence of ambient lighting conditions surrounding the display, while accounting for content-specific adaptations indicated the content items themselves. Successfully modeling the user's current viewing environment and its impact on perception of displayed content would allow the user's perception of the displayed content to remain relatively independent of the ambient conditions in which the display is being viewed and/or other content displayed simultaneously.

SUMMARY

As mentioned above, human perception is not absolute; rather, it is relative. In other words, a human user's perception of a displayed image changes based on what surrounds the image, the image itself, and what brightness and white point the viewer is presently adapted to. A display may commonly be positioned in front of a wall. In this case, the ambient lighting in the room (e.g., brightness and color) illuminates the wall behind the display and changes the viewer's perception of the displayed image. Potential changes in a viewer's perception of the displayed content include tonality changes (which may be modeled using a gamma function), as well as changes to white point (the absolute color perceived as being white) and black point (the highest brightness level indifferentiable from true black).

Thus, while some devices may attempt to maintain a consistent content adaptation on the eventual display device throughout the encoding, decoding, and color management processes, this does not take into account the effect environmental conditions around the display device may have on a viewer's perception of displayed content. Many color-management systems attempt to consistently map the content to the display such that the content's encoding and the display's reproduction do not influence the resulting displayed content, thus providing consistency across content encoding and displays. However, these color-management systems require fixed viewing conditions, such as always using the intended display and suggested viewing environment.

A processor in communication with the display device may map multiple content items to a display color space associated with display device according to content indicators included in the content items. The content indicators may indicate an intended viewing environment and a corresponding display brightness, white point, black point, gamma boost, and the like. The processor may then transition the adapted content items into a common compositing space, such that a content item intended for a first viewing environment and a first gamma boost, and a content item intended for a second viewing environment and a second gamma boost are adapted for a same viewing environment and a same gamma boost. Once transitioned to the common compositing space, the content items and the same gamma boost may be adapted for the viewer's current viewing environment.

A first adaptation process, called the simultaneous contrast adaptation process, maps each content item to its suggested viewing environment using techniques indicated in the content item by content indicators. For example, a content item intended for viewing on a rec.709 display includes content indicators to use an RGB-space gamma. The resulting, simultaneous contrast adapted content item is referred to herein as color space data for the suggested viewing environment. A second adaptation process, by itself or in combination with the simultaneous contrast adaptation process, adapts each item of color space data for the suggested viewing environment to the shared, system-level viewing environment using best practices. The system-level viewing environment corresponds to a shared, compositing color-space of the display. The resulting, color-space data adapted to the system-level viewing environment for all the content items is described herein as the composited color-space data. The system-level viewing environment may be dynamically changed to match the user's current viewing environment. Alternatively, the system-level viewing environment may be held constant, and a third process may be performed globally on the composited color-space data to adapt the fixed, system-level viewing environment to the current viewing environment. The third adaptation process is agnostic to the individual content items that produced the composited color-space data and may use different simultaneous contrast correction processes than those used in the first simultaneous contrast adaptation process. For example, the third adaptation process may implement correction processes that are more sophisticated or more efficient than those indicated in the constituent content items.

The techniques disclosed herein use a display device, in conjunction with various optical sensors, e.g., potentially multi-spectral ambient light sensor(s), image sensor(s), or video camera(s), to collect information about the ambient conditions in the current viewing environment of a viewer of the display device. Use of these various optical sensors can provide more detailed information about the ambient lighting conditions, which the processor may utilize to evaluate an ambient conditions model, based at least in part, on the received environmental information and information about the display such as the display's peak brightness, reference brightness (SDR max), white point, as well as the instantaneous, historic, and even future content itself that is being, has been, or will be displayed to the viewer. Further information about the user including both instantaneous and historic information pertaining to where the viewer's gaze is, and how bright the object or content the viewer is or has been watching inform a dynamic user perception model. The output from the ambient conditions model may be used to adapt the content, such that the viewer's perception of the content displayed on the display device is relatively independent of the ambient conditions in which the display is being viewed, what the viewer sees on and beyond the display, and hence how the user's vision is adapted. The output of the ambient conditions model may comprise modifications to the display's transfer function, gamma boost, tone mapping, re-saturation, black point, white point, or a combination thereof.

Thus, according to some embodiments, a non-transitory program storage device comprising instructions stored thereon is disclosed. When executed, the instructions are configured to cause one or more processors to receive a first content item authored in a first source color space and encoded with a first intended adaptation for a first intended viewing environment; receive a second content item authored in a second source color space and encoded with a second intended adaptation for a second intended viewing environment; adapt the first content item to a display color space associated with a display device and the first intended viewing environment based on the first intended adaptation; adapt the second content item to the display color space and the second intended viewing environment based on the second intended adaptation; transition the adapted first and second content items to a common compositing space; apply a system adaptation process of the display device to the adapted first and second content items in the common compositing space; and cause the adapted first and second content items to be displayed on the display device.

In some embodiments, the non-transitory program storage device further comprises machine instructions to cause the one or more processor to: receive a first characteristic for the first content item; and receive a second characteristic for the second content item. The instructions to adapt the first content item and the second content item to a display color space associated with the display device comprise instructions to adapt the first content item based on the first characteristic and the second content item based on the second characteristic. In some embodiments, the non-transitory program storage device further comprises machine instructions to cause the one or more processors to adjust the system adaptation process of the display device based on a user setting.

In some embodiments, the non-transitory program storage device further comprises machines instructions to cause the one or more processors to adjust the system adaptation process of the display device based on ambient light conditions surrounding the display device. The instructions to adjust the system adaptation process of the display device based on ambient light conditions may comprise instructions to cause the one or more processors to: receive data indicative of a characteristic of the display device; receive data indicative of the ambient light conditions; and evaluate an ambient conditions model based, at least in part, on the data indicative of the characteristic of the display device and the data indicative of the ambient light conditions, wherein the instructions to evaluate the ambient conditions model comprise instructions to determine an adjustment to the system adaptation process of the display device.

In other embodiments, the aforementioned techniques embodied in instructions stored in non-transitory program storage devices may also be practiced as methods and/or implemented on electronic devices having display, e.g., a mobile phone, PDA, HMD, monitor, television, or a laptop, desktop, or tablet computer.

DETAILED DESCRIPTION

The disclosed techniques use a display device, in conjunction with various optical sensors, e.g., ambient light sensors or image sensors, to collect information about the ambient conditions in the environment of a viewer of the display device. Use of the ambient environment information; information regarding the display device and its characteristics; and information about the content being displayed, its intended display type, and its suggested viewing environment can provide a more accurate prediction of the viewer's current viewing environment and its impact on how the user perceives the displayed content. A processor in communication with the display device may evaluate an ambient conditions model based, at least in part, on the predicted effects of the ambient conditions (and/or the content itself) on the viewer's perception. The output of the ambient conditions model may be suggested modifications that are used to perform environmental adaptation on the content to be displayed and parameters of the display device itself (e.g., suggested adjustments to the gamma, black point, white point, and/or saturation), such that the viewer perceives the adapted display content as intended, while remaining relatively independent of the current ambient conditions.

The techniques disclosed herein are applicable to any number of electronic devices: such as digital cameras, digital video cameras, mobile phones, personal data assistants (PDAs), head-mounted display (HMD) devices, monitors, televisions, digital projectors (including cinema projectors), as well as desktop, laptop, and tablet computer displays.

In the interest of clarity, not all features of an actual implementation are described in this specification. It will of course be appreciated that in the development of any such actual implementation (as in any development project), numerous decisions must be made to achieve the developers' specific goals (e.g., compliance with system- and business-related constraints), and that these goals will vary from one implementation to another. It will be appreciated that such development effort might be complex and time-consuming, but would nevertheless be a routine undertaking for those of ordinary skill having the benefit of this disclosure. Moreover, the language used in this disclosure has been principally selected for readability and instructional purposes, and may not have been selected to delineate or circumscribe the inventive subject matter, with resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

Figure 1A:
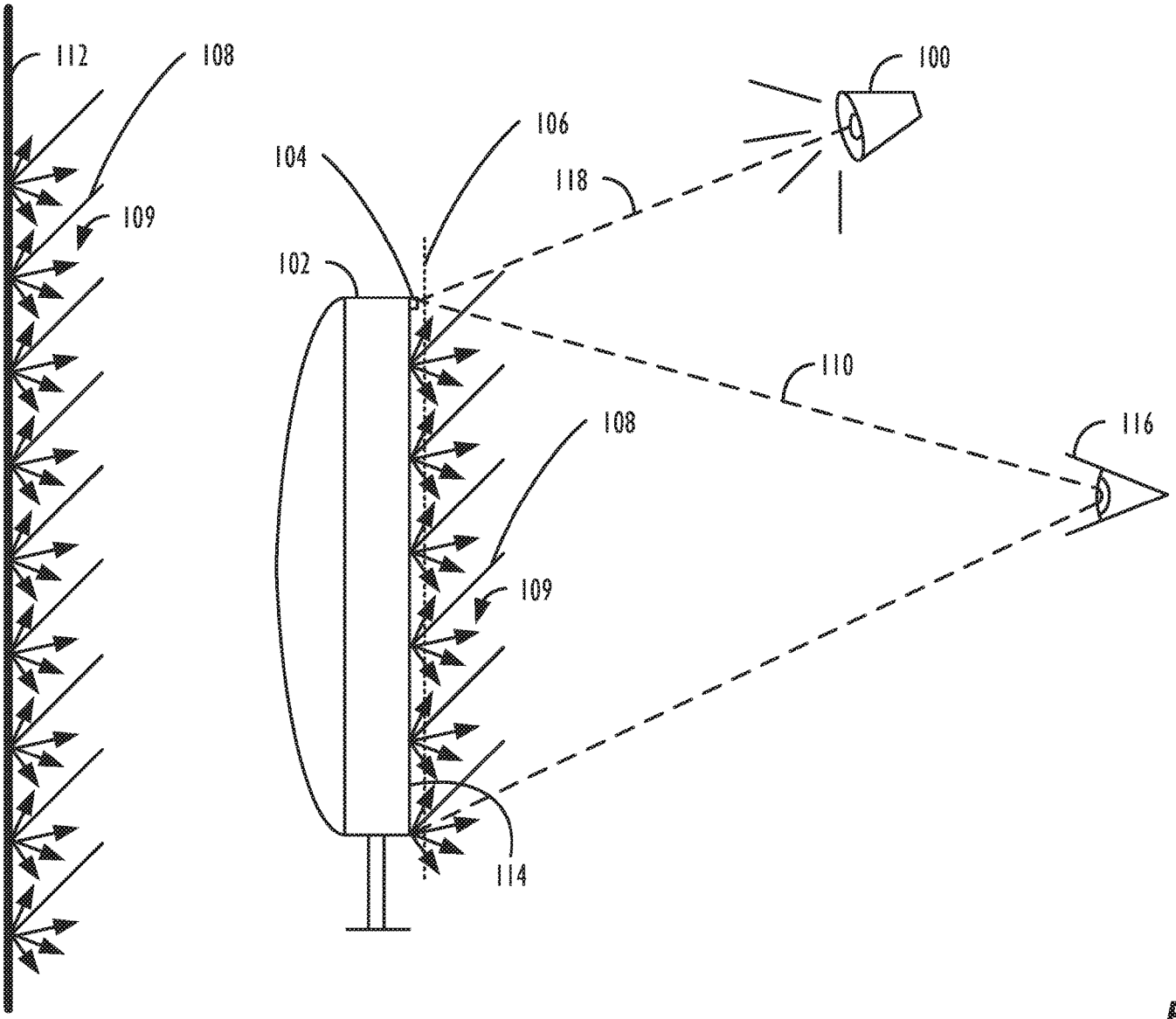
FIG. 1A illustrates the properties of ambient lighting, diffuse reflection off a display device, and other environmental conditions influencing a display device.

Referring now to FIG. 1A, the properties of ambient lighting, diffuse reflection off a display device 102, and other environmental conditions influencing the display device are shown via the depiction of a side view of a viewer 116 of the display device 102 in a particular ambient lighting environment. As shown in FIG. 1A, viewer 116 is looking at display device 102, which, in this case, is a typical desktop computer monitor. Dashed lines 110 represent the viewing angle of viewer 116. The ambient environment as depicted in FIG. 1A is lit by environmental light source 100, which casts light rays 108 onto all of the objects in the environment, including wall 112 as well as the display surface 114 of display device 102. As shown by the multitude of small arrows 109 (representing reflections of light rays 108), a certain percentage of incoming light radiation will reflect off of the surface that it shines upon. Diffuse reflection may be defined as the reflection of light from a surface such that an incident light ray is reflected at many angles, and has a particular effect on a viewer's perception of display device 102.

When the brightness of reflected light and/or the brightness of light leakage from display device 102 is greater than the brightness of pixels driven by the display device for a content item, the viewer may not be able to perceive low tonal details in the content item. This effect is illustrated by dashed line 106 in FIG. 1A, which indicates a threshold brightness level. When the brightness of pixels in the emissive display surface 114 is less than the threshold brightness level indicated by dashed line 106, the pixels are not perceived as intended. When the brightness of pixels in the emissive display surface 114 is greater than the threshold brightness level, the pixels are perceived as intended. The dashed line 106 and the threshold brightness level may be adjusted to account for each of the reflected light and light leakage from the display device 102, either alone or in combination. The influence of reflected light and light leakage from the display device on the viewer's perception of displayed content is described further herein with respect to FIG. 18. Information regarding diffuse reflection and other ambient light in the current viewing environment may be used to inform an ambient conditions model that suggests which adaptation processes to perform on content to compensate for environmental conditions, or suggests modifications to adaptation processes already being performed.

The information regarding diffuse reflection and other ambient light may be based off of light level readings recorded by one or more optical sensors, e.g., ambient light sensor 104. Dashed line 118 represents data indicative of the light source being collected by ambient light sensor 104. Optical sensor 104 may be used to collect information about the ambient conditions in the environment of the display device and may comprise, e.g., an ambient light sensor, an image sensor, or a video camera, or some combination thereof. A front-facing image sensor provides information regarding how much light (and, in some embodiments, what color of light) is hitting the display surface 114. This information may be used in conjunction with a model of the reflective and diffuse characteristics of the display to inform the ambient conditions model about the particular lighting conditions that the display is currently in and that the user is currently adapted to. Although optical sensor 104 is shown as a "front-facing" image sensor, i.e., facing in the general direction of the viewer 116 of the display device 102, other optical sensor types, placements, positioning, and quantities are possible. For example, one or more "back-facing" image sensors alone (or in conjunction with one or more front facing sensors) could give even further information about light sources and the color in the viewer's environment. The back-facing sensor collects light from emissive sources or re-reflected off objects behind the display, and may be used to determine the brightness of the display's surroundings, i.e., what the user sees beyond the display. This information may also be used for the ambient conditions model. For example, the color of wall 112, if it is close enough behind display device 102 could have a profound effect on the viewer's perception. Likewise, in the example of an outdoor environment, the color and intensity of light surrounding the viewer can make the display appear different than it would an indoor environment with, e.g., incandescent (colored) lighting.

In one embodiment, the optical sensor 104 may comprise a video camera (or other devices) capable of capturing spatial information, color information, as well as intensity information. With regard to spatial information, a video camera or other device(s) may also be used to determine a viewing user's distance from the display, e.g., to further model how much of the user's field of view the display fills and, correspondingly, how much influence the display/environment will have on the user's perception of displayed content. In some embodiments, a video camera may be configured to capture images of the surrounding environment for analysis at some predetermined time interval, e.g., every two minutes, such that the ambient conditions model may be gradually updated or otherwise changed as the ambient conditions in the viewer's environment change.

Additionally, a back-facing video camera used to model the surrounding environment could be designed to have a field of view roughly consistent with the calculated or estimated field of view of the viewer of the display. Once the field of view of the viewer is calculated or estimated, e.g., based on the size or location of the viewer's facial features as recorded by a front-facing camera, assuming the native field of view of the back-facing camera is known and is larger than the field of view of the viewer, the system may then determine what portion of the back-facing camera image to use in the surround computation.

In still other embodiments, one or more cameras or depth sensors may be used to further estimate the distance of particular surfaces from the display device. This information could, e.g., be used to further inform the ambient conditions model based on the likely composition of the viewer's surround and the perceptual impacts thereof. For example, a display with a 30" diagonal sitting 18" from a user will have a greater influence on the user's vision than the same display sitting 48" away from the user, filling less of the user's field of view.

Figure 1B:
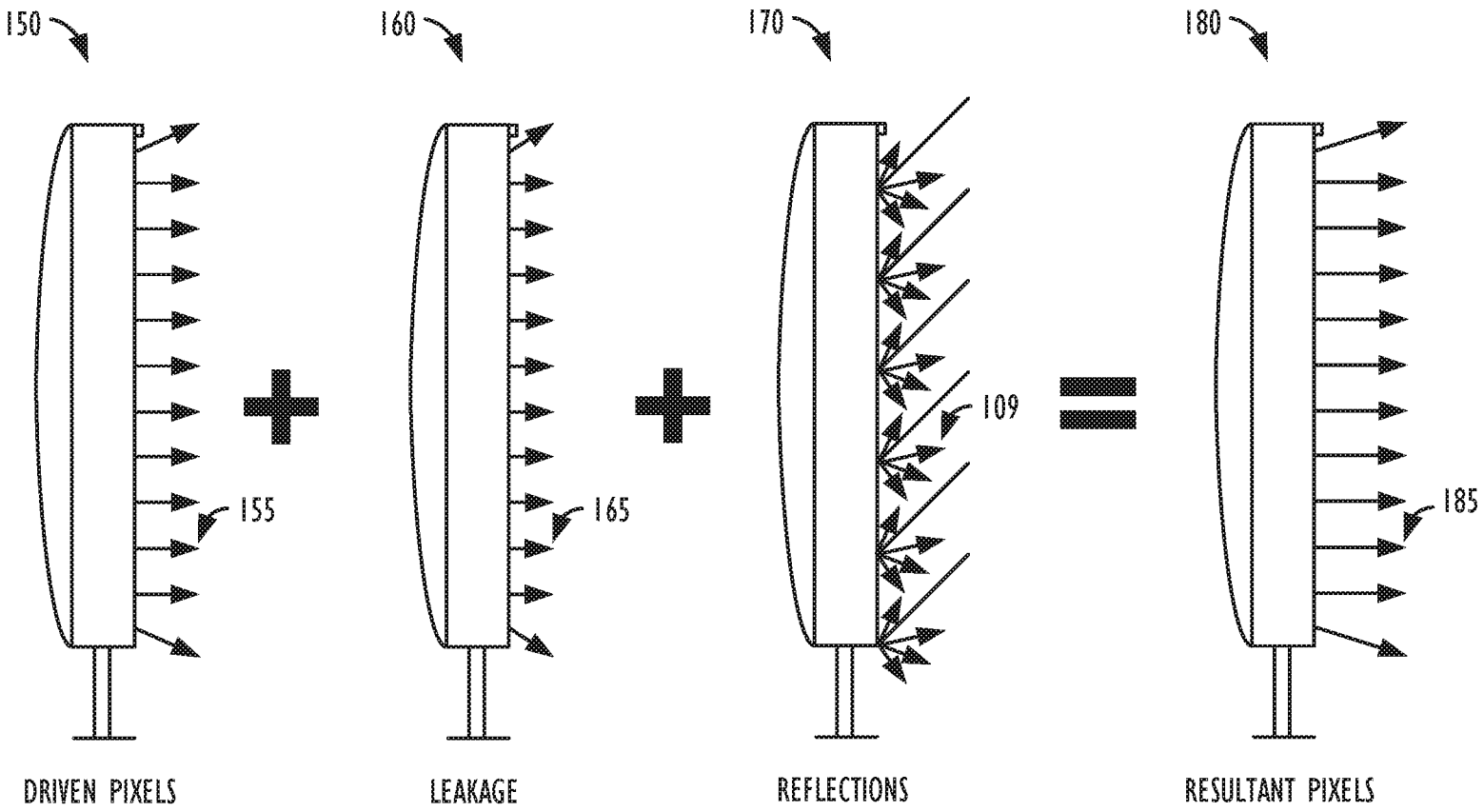
FIG. 1B illustrates the additive effects of unintended light on a display device.

Referring now to FIG. 1B, the additive effects of unintended light on a display device are shown in more detail. For example, the light rays 155 emitting from display representation 150 represent the amount of light that the display is intentionally driving the pixels to produce at a given moment in time. Likewise, light rays 165 emitting from display representation 160 represent the amount of light leakage from the display at the given moment in time, and light rays 109 reflecting off display representation 170 represent the aforementioned diffuse reflection of ambient light rays off the surface of the display at the given moment in time. There may be more diffuse reflection off of non-glossy displays than off of glossy displays, in displays of stacked components compared to laminated components, or off of clean displays compared to dusty or otherwise dirty displays. Finally, display representation 180 represents the summation of the three forms of light illustrated in display representations 150, 160, and 170.

As illustrated in FIG. 1B, the light rays 185 emitting from display representation 180 represent the actual amount of light that perceived by a viewer of the display device, which may be different than the initial amount of light 155 pixels in the display were intentionally driven with in order to produce the desired content. The unintended light from display leakage, diffuse reflections, and the like may desaturate perceived colors compared to the content's intended color. The darker or dimmer the intended color is, the more pronounced the desaturation appears to a viewer. Thus, accounting for the effects of these various phenomenon may help to achieve a more consistent and content-accurate perceptual experience across viewing environments.

Thus, in one or more embodiments disclosed herein, an ambient conditions model for dynamically selecting which environmental adaptations to perform or adjusting environmental adaptations already being performed may compensate for unintended light, such that the dimmest colors are not masked by light leakage and/or the predicted diffuse reflection levels and all the colors are not perceived as desaturated compared to the intended colors. A model of the display device characteristics may be used to determine an amount of light leakage from the display device under the current display parameters. The model of the display device characteristics may also be used in combination with information from ambient light sensor 104 to estimate an amount of diffuse reflection off the display device. A perceptual model may be used to estimate an amount of desaturation from unintended light, such that the ambient conditions model may determine a recommended resaturation and environmental adaptations to achieve the recommended re-saturation.

Figure 2:
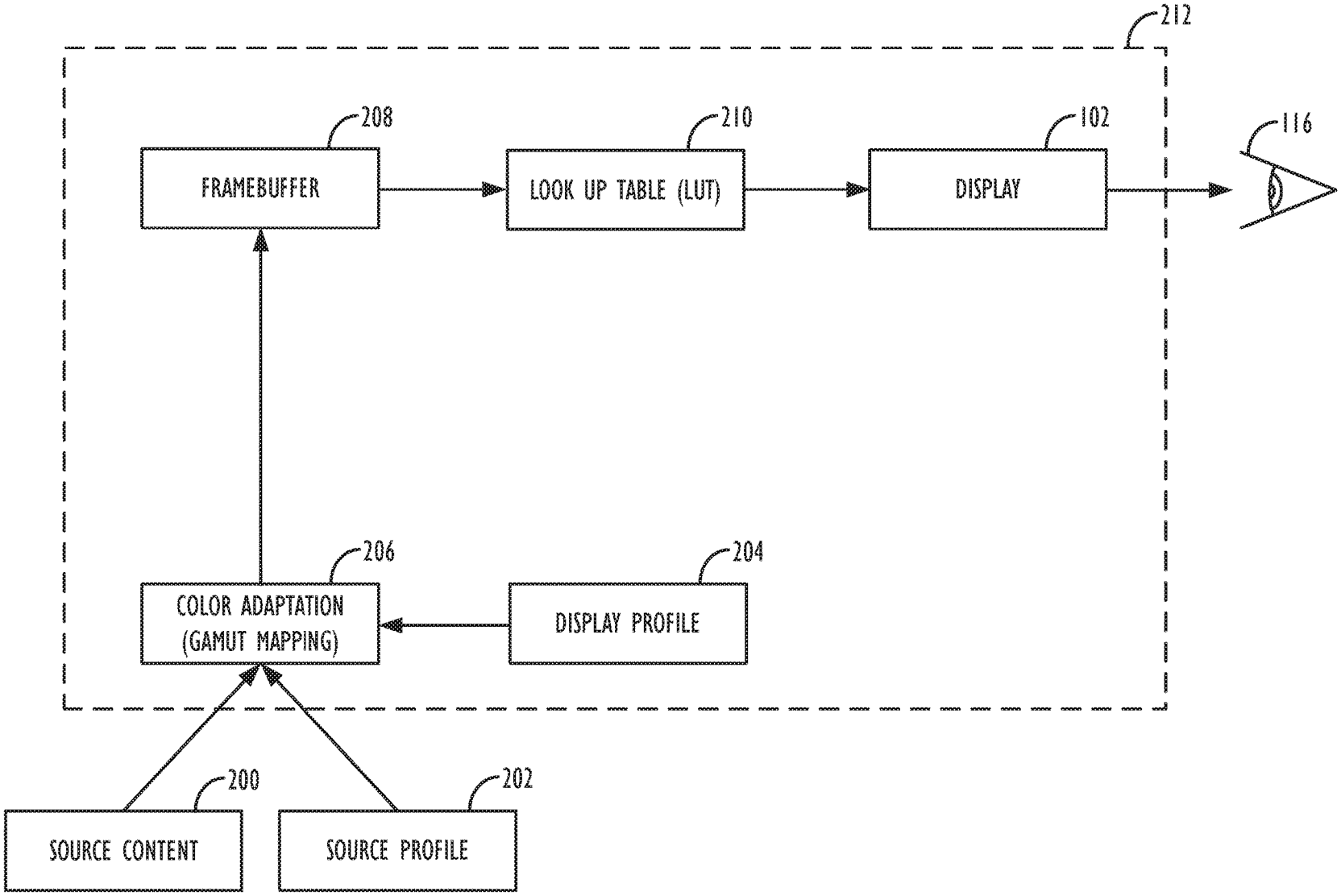
FIG. 2 illustrates a system for performing gamma adjustment utilizing a look up table.

Referring now to FIG. 2, a typical system 212 for performing gamma adjustment utilizing a Look Up Table (LUT) 210 is shown. Element 200 represents the source content, created by, e.g., a source content author, that viewer 116 wishes to view. Source content 200 may comprise an image, video, or other displayable content type. Element 202 represents the source profile, that is, information describing the color profile and display characteristics of the device on which source content 200 was authored by the source content author. Source profile 202 may comprise, e.g., an ICC profile of the author's device or color space (which will be described in further detail below), or other related information.

Information relating to the source content 200 and source profile 202 may be sent to viewer 116's device containing the system 212 for performing gamma adjustment utilizing a LUT 210. Viewer 116's device may comprise, for example, a mobile phone, PDA, HMD, monitor, television, or a laptop, desktop, or tablet computer. Upon receiving the source content 200 and source profile 202, system 212 may perform a color adaptation process 206 on the received data, e.g., for performing gamut mapping, i.e., color matching across various color spaces. For instance, gamut matching tries to preserve (as closely as possible) the relative relationships between colors (e.g., as authored/approved by the content author on the display described by the source ICC profile), even if all the colors must be systematically changed or adapted in order to get them to display on the destination device.

Once the color profiles of the source and destination have been appropriately adapted, image values may enter the so-called "framebuffer" 208. In some embodiments, image values, e.g., pixel luma values, enter the framebuffer having come from an application or applications that have already processed the image values to be encoded with a specific implicit gamma. A framebuffer may be defined as a video output device that drives a video display from a memory buffer containing a complete frame of, in this case, image data. The implicit gamma of the values entering the framebuffer can be visualized by looking at the "Framebuffer Gamma Function," as will be explained further below in relation to FIG. 3. Ideally, this Framebuffer Gamma Function is the exact inverse of the display device's "Native Display Response" function, which characterizes the luminance response of the display to input.

Because the inverse of the Native Display Response isn't always exactly the inverse of the framebuffer, a LUT, sometimes stored on a video card or in other memory, may be used to account for the imperfections in the relationship between the encoding gamma and decoding gamma values, as well as the display's particular luminance response characteristics. Thus, if necessary, system 212 may then utilize LUT 210 to perform a so-called "gamma adjustment process." LUT 210 may comprise a two-column table of positive, real values spanning a particular range, e.g., from zero to one. The first column values may correspond to an input image value, whereas the second column value in the corresponding row of the LUT 210 may correspond to an output image value that the input image value will be "transformed" into before being ultimately being displayed on display 102. LUT 210 may be used to account for the imperfections in the display 102's luminance response curve, also known as the "display transfer function." In other embodiments, a LUT may have separate channels for each primary color in a color space, e.g., a LUT may have Red, Green, and Blue channels in the sRGB color space.

The transformation applied by the LUT to the incoming framebuffer data before the data is output to the display device may be used to ensure that a desired 1.0 gamma boost is applied to the eventual display device. The system shown in FIG. 2 is generally a good system, although it does not take into account the effect of differences or changes in ambient light conditions on the perceived gamma, or gamma adjustments already encoded in the source content 200 by the source author to compensate for differences between the source content capture environment and the source content 200's intended viewing environment. In other words, the 1.0 gamma boost for encoding and decoding content is only achieved/appropriate in one ambient lighting environment, and this environment is typically brighter than a normal office environment. For example, content captured in a bright environment won't require a gamma boost, e.g., due to the "simultaneous contrast" phenomenon, if viewed in the identical (i.e., bright) environment. For another example, content captured and edited in a bright environment but intended for viewing in a dim environment may already include gamma adjustments in the source content 200 received by system 212. Additional gamma boost based on LUT 210 distorts the gamma adjustments already provided in the source content 200 and causes the displayed content to differ from the source author's intent.

As mentioned above, in some embodiments, the goal of this gamma adjustment system 212 is to have an overall 1.0 system gamma applied to the content that is being displayed on the display device 102. An overall 1.0 system gamma corresponds to a linear relationship between the input encoded luma values and the output luminance on the display device 102. Ideally, an overall 1.0 system gamma will cause the displayed content to appear largely as the source author intended, despite the intervening encoding and decoding of the content, and other color management processes used to adapt the content to the particular display device 102. However, as will be described later, this overall 1.0 gamma may only be properly perceived in one particular set one set of ambient lighting conditions, thus necessitating the need for a dynamic display adjustment system to accommodate different ambient lighting conditions and adjust the overall system gamma to achieve a perceived system gamma of 1.0. Further, gamma adjustment is only one kind of correction for environmental conditions, and environmental adaptations described herein include gamma adjustment as well as resaturation, black point and white point adjustment, and the like.

Figure 3:
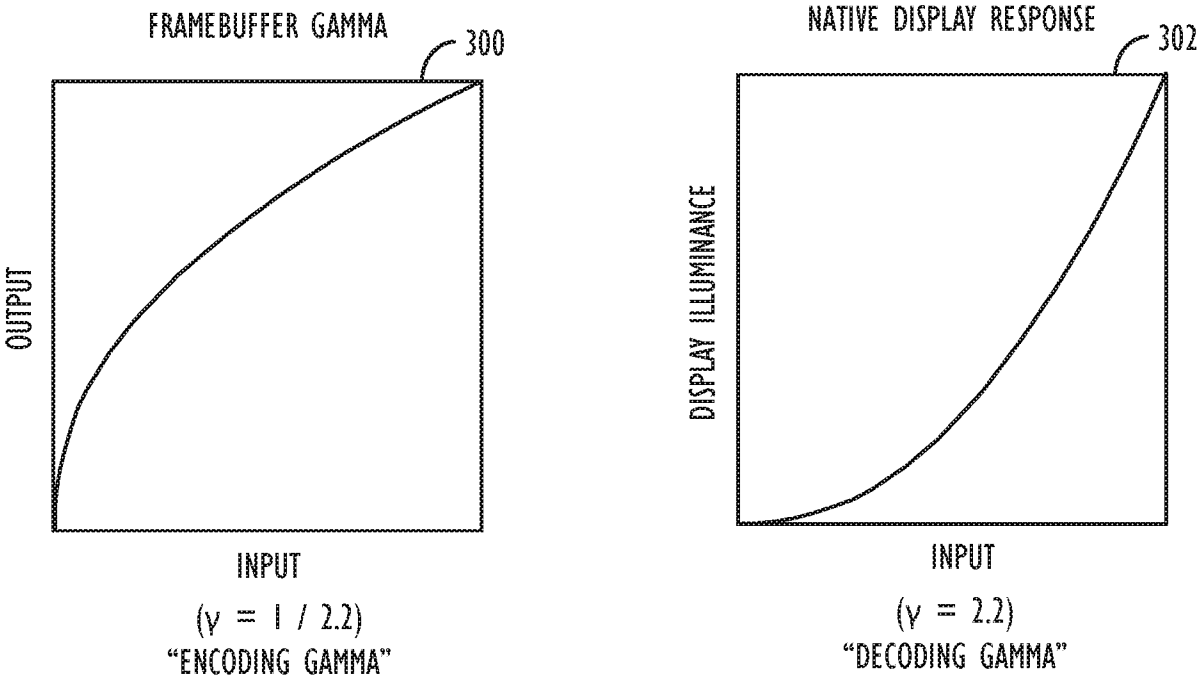
FIG. 3 illustrates a Framebuffer Gamma Function and an exemplary Native Display Response.

Referring now to FIG. 3, a Framebuffer Gamma Function 300 and an exemplary Native Display Response 302 is shown. Gamma adjustment, or, as it is often simply referred to, "gamma," is the name given to the nonlinear operation commonly used to encode luma values and decode luminance values in video or still image systems. Gamma, $\gamma$, may be defined by the following simple power-law expression: $L_{out}=L_{in}^{\gamma}$, where the input and output values, $L_{in}$ and $L_{out}$, respectively, are non-negative real values, typically in a predetermined range, e.g., zero to one. A gamma value greater than one is sometimes called an "encoding gamma," and the process of encoding with this compressive power-law nonlinearity is called "gamma compression;" conversely, a gamma value less than one is sometimes called a "decoding gamma," and the application of the expansive power-law nonlinearity is called "gamma expansion." Gamma encoding of content helps to map the content data into a more perceptually-uniform domain.

Another way to think about the gamma characteristic of a system is as a power-law relationship that approximates the relationship between the encoded luma in the system and the actual desired image luminance on whatever the eventual user display device is. In existing systems, a computer processor or other suitable programmable control device may perform gamma adjustment computations for a particular display device it is in communication with based on the native luminance response of the display device, the color gamut of the device, and the device's white point (which information may be stored in an ICC profile), as well as the ICC color profile and other content indicators that the source content's author attached to the content to specify the content's "rendering intent."

The ICC profile is a set of data that characterizes a color input or output device, or a color space, according to standards promulgated by the International Color Consortium (ICC). ICC profiles may describe the color attributes of a particular device or viewing requirement by defining a mapping between the device source or target color space and a profile connection space (PCS), usually the CIE XYZ color space. ICC profiles may be used to define a color space generically in terms of three main pieces: 1) the color primaries that define the gamut; 2) the transfer function (sometimes referred to as the gamma function); and 3) the white point. ICC profiles may also contain additional information to provide mapping between a display's actual response and its "advertised" response, i.e., its tone response curve (TRC), for instance, to correct or calibrate a given display to a perfect 2.2 gamma response.

In some implementations, the ultimate goal of the gamma adjustment process is to have an eventual overall 1.0 gamma boost, i.e., so-called "unity" or "no boost," applied to the content as it is displayed on the display device. An overall 1.0 system gamma corresponds to a linear relationship between the input encoded luma values and the output luminance on the display device, meaning there is actually no amount of gamma "boosting" being applied, and the gamma encoding process is undone by the gamma decoding process, without further adjustment.

Classically, a gamma encoding is optimized for a particular environment, dynamic range of content, and dynamic range of display, such that the encoding and display codes are well-spaced across the intended range and the content appears as intended (e.g., not banded, without crushed highlights or blacks, and with correct contrast—sometimes called tonality, etc.). 8-bit 2.2 gamma is an example of an acceptable representation for encoding SDR (standard dynamic range) content to be displayed on a 1/2.45 gamma rec.709 CRT in a bright-office viewing environment.

However, the example SDR content will not have the intended appearance when viewed in an environment that is brighter or dimmer than the intended, bright-office viewing environment, even when displayed on its intended rec.709 display. When the current viewing environment differs from the suggested viewing environment, for instance is brighter than the suggested viewing environment, the user's vision adapts to the current, brighter viewing environment such that the user perceives fewer distinguishable details in the darker portions of the content. The display may only be able to modulate a small range of the user's vision as adapted to the current, brighter viewing environment. Further, the display's fixed maximum brightness may be dim compared to the brightness of the current viewing environment.

The current, brighter viewing environment prevents the user from perceiving the darker portions in the content that the source author intended the viewer to perceive when the content is viewed on the suggested rec.709 display in the suggested, bright-office viewing environment. In other words, "shadow detail" is "crushed" to black. This effect is magnified when ambient light from the viewing environment is reflected off the display and/or light from display leakage, collectively called unintended light, further limit how dark the content is perceived by the viewer. The lowest codes in the content are spaced apart in brightness based on the suggested viewing environment and may be too closely spaced to be differentiable in the current, brighter viewing environment.

The perceived, overall tonality of the content differs when the current viewing environment differs from the suggested viewing environment as well. For example, the content may appear lower in contrast when the current viewing environment is brighter than the suggested viewing environment. The content may also appear desaturated, with an unintended color cast, due to unintended light from reflections off the display and/or display leakage, or when the white point of the suggested viewing environment differs from the white point of the current viewing environment.

Even when viewed on the suggested rec.709 display in the suggested, bright-office viewing environment, the tonality of the content may be perceived differently based on what other content is displayed at the same time, an effect described as "simultaneous contrast." Some devices display multiple content items at a time, for example a user's work computer may display multiple documents and a video at the same time. The different content items may be tailored for different suggested viewing environments, such that each content item uses a different gamma encoding and a different gamma boost. Display devices that implement the same gamma boost to all the content items distort the individual content items away from their intended appearances.

For instance, rec.709 content has an overall 1.22 gamma boost from the intentional mismatch between the content's encoding gamma and the display's decoding gamma, to compensate for bright-surround content being viewed in a dim-surround environment. In contrast, DCI P3 content directly encodes the compensation for bright-surround content being viewed in a dim-surround environment into the pixels themselves, such that no gamma boost is needed, that is, a 1.0 gamma is sufficient. No single gamma boost is appropriate for both the rec.709 content and the DCI P3 content in any viewing environment. While this example describes differences in gamma boost, similar differences may be found in other kinds of content adaptation, such as tone mapping, re-saturation, black point and/or white point adjustments, modified transfer functions for the display, and combinations thereof. As used herein, "surround environment" refers to ambient lighting conditions and the like in the environment around the display device. A "viewing environment" refers to the surround environment around the display device and display characteristics such as leakage that influence how a user perceives content displayed on the display device.

Returning now to FIG. 3, the x-axis of Framebuffer Gamma Function 300 represents input image values spanning a particular range, e.g., from zero to one. The y-axis of Framebuffer Gamma Function 300 represents output image values spanning a particular range, e.g., from zero to one. As mentioned above, in some embodiments, image values may enter the framebuffer 208 already having been processed and have a specific implicit gamma. As shown in graph 300 in FIG. 3, the encoding gamma is roughly 1/2.2, or 0.45. That is, the line in graph 300 roughly looks like the function, $L_{OUT}=L_{IN}^{0.45}$. Gamma values around 1/2.2, or 0.45, are typically used as encoding gammas because the native display response of many display devices have a gamma of roughly 2.2, that is, the inverse of an encoding gamma of 1/2.2. In other cases, a gamma of, e.g., 1/2.45, may be applied to 1.96 gamma encoded content when displayed on a conventional 1/2.45 gamma CRT display, in order to provide the 1.25 gamma "boost" (i.e., 2.45 divided by 1.96), required to compensate for the simultaneous contrast effect causing bright content to appear low-contrast when viewed in a dim surround environment (i.e., the area beyond the display is typically more dim), such as the 16 lux rec.709 viewing environment. If the content already includes additional gamma boost because the source author intended the bright content to be viewed in a dim surround environment and framebuffer 208 does not account for this encoded gamma boost, the resulting gamma boost will differ from the source author's rendering intent.

The x-axis of Native Display Response Function 302 represents input image values spanning a particular range, e.g., from zero to one. The y-axis of Native Display Response Function 302 represents output image values spanning a particular range, e.g., from zero to one. In theory, systems in which the decoding gamma is the inverse of the encoding gamma should produce the desired overall 1.0 system gamma. However, this fails to account for ambient light in the environment around the display device and/or the gamma boost already encoded into the source content. Thus, the desired overall 1.0 system gamma is only achieved in one ambient lighting environment, e.g., the authoring lighting environment or, where gamma boost is already encoded into the source content, the intended viewing environment. These systems do not dynamically adapt to environmental conditions surrounding the display device, or according to user preferences.

Figure 4:
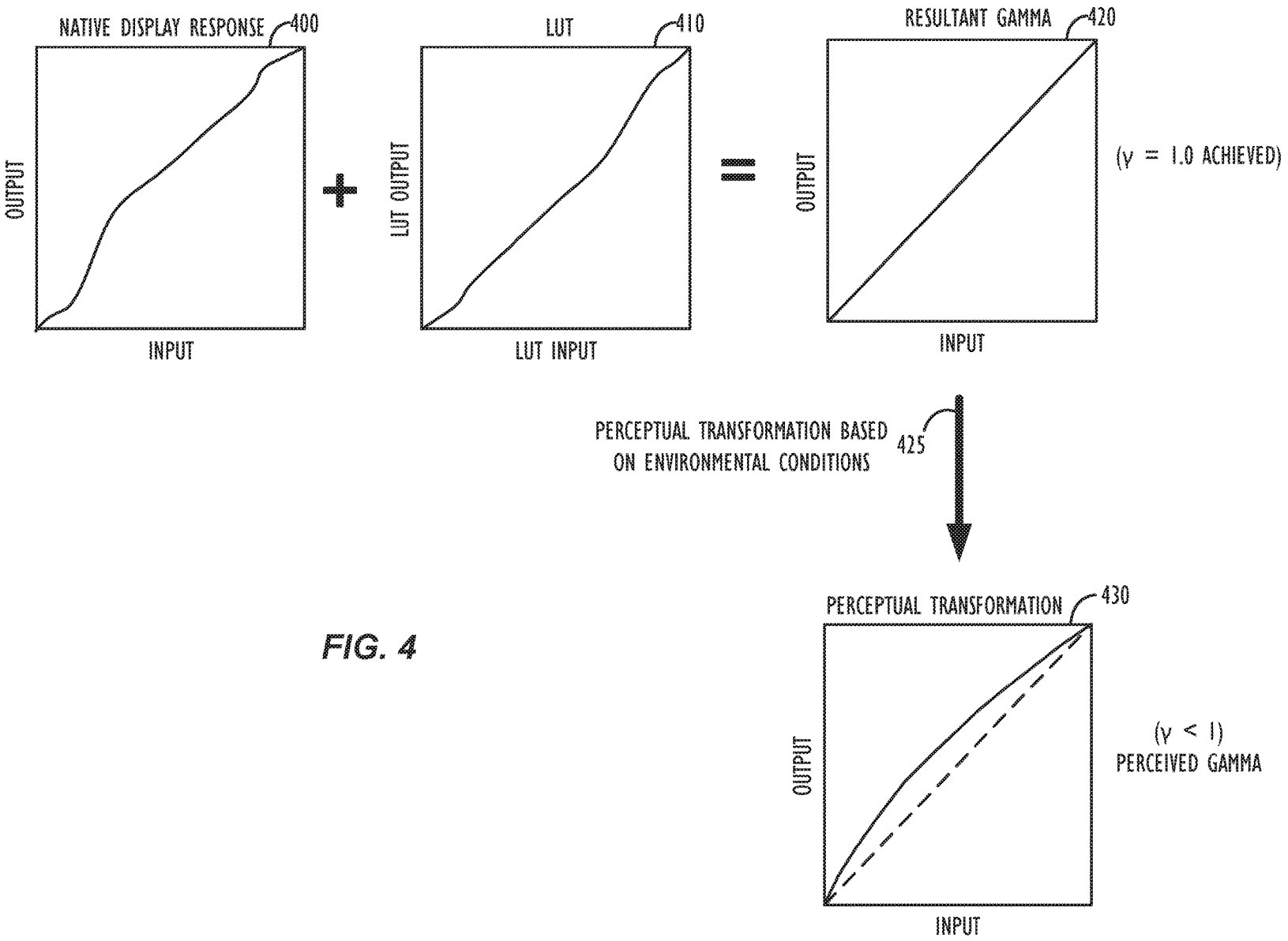
FIG. 4 illustrates graphs representative of a LUT transformation and a Resultant Gamma Function, as well as a graph indicative of a perceptual transformation due to environmental conditions.

Referring now to FIG. 4, graphs representative of a LUT transformation and a Resultant Gamma Function are shown, as well as a graph indicative of a perceptual transformation due to environmental conditions. The graphs in FIG. 4 show how, in an ideal system, a LUT may be utilized to account for the imperfections in the relationship between the encoding gamma and decoding gamma values, as well as the display's particular luminance response characteristics at different input levels. The graphs in FIG. 4 also illustrate how the environmental conditions surrounding the display device may then distort perception of the content such that the perceived gamma differs from the Resultant Gamma Function. The x-axis of native display response graph 400 represents input image values spanning a particular range, e.g., from zero to one. The y-axis of native display response graph 400 represents output image values spanning a particular range, e.g., from zero to one. The non-straight line nature of graph 400 represents the minor peculiarities and imperfections in the exemplary display's native response function. The x-axis of LUT graph 410 represents input image values spanning the same range of input values the display is capable of responding to, e.g., from zero to one. The y-axis of LUT graph 410 represents the same range of output image values the display is capable of producing, e.g., from zero to one. In an ideally calibrated display device, the display response 400 will be the inverse of the LUT response 410, such that, when the LUT graph is applied to the input image data, the Resultant Gamma Function 420 reflects a desired overall system 1.0 gamma response, i.e., resulting from the adjustment provided by the LUT and the native (nearly) linear response of the display, and the content is perceived as the source author intended. The x-axis of Resultant Gamma Function 420 represents input image values as authored by the source content author spanning a particular range, e.g., from zero to one. The y-axis of Resultant Gamma Function 420 represents output image values displayed on the resultant display spanning a particular range, e.g., from zero to one. The slope of 1.0, reflected in the line in graph 420, indicates that luminance levels intended by the source content author will be reproduced at corresponding luminance levels on the ultimate display device.

Ideally, the Resultant Gamma Function 420 reflects a desired overall 1.0 system gamma on the resultant display device, indicating that the tone response curves (i.e., gamma) are matched between the source and the display, that the gamma encoding of the content has been undone by the gamma decoding process without further adjustment, and that the image on the display is likely being displayed more or less as the source's author intended. However, this calculated overall 1.0 system gamma does not take into account the effect of ambient lighting conditions on the viewer's perception of the gamma boost. In other words, due to perceptual transformations caused by ambient conditions in the viewer's environment 425, the viewer does not perceive the content as the source author intended and does not perceive an overall 1.0 gamma in all lighting conditions. The calculated overall 1.0 gamma may further fail to take into account the effect on the viewer's current adaptation to the ambient light conditions. As described above, a user's ability to perceive changes in light intensity (as well as the overall range of light intensities that their eyes may be able to perceive) is further based on what levels of light the user's eyes have been around (and thus adjusted to) over a preceding window of time (e.g., 30 seconds, 5 minutes, 15 minutes, etc.) The calculated overall 1.0 gamma may also fail to take into account a gamma boost already encoded into the source content by the source author based on the source capture and editing environments and the intended viewing environment. For example, a video may be filmed in a bright environment but have been edited for viewing in a dim environment, with a gamma boost matching this transition already encoded into the video. If a system tries to further adjust the already adjusted gamma boost, the resultant gamma differs from the source author's rendering intent.

As is shown in graph 430, the dashed line indicates a perceived 1.0 gamma boost, the viewer's actual perception of the achieved system gamma, which corresponds to an overall gamma boost that is greater than 1.0. The ambient conditions in the viewing surround transformed the achieved system gamma of greater than 1.0 into a perceived system gamma of equal to 1.0. Thus, an ambient conditions model for dynamically adjusting a display's characteristics according to one or more embodiments disclosed herein may be able to account for the perceptual transformation due to the viewer's environmental conditions, cause the display to boost the achieved system gamma above the intended 1.0 system gamma, and thus present the viewer with what he or she will perceive as an overall 1.0 system gamma, causing the content to be perceived as the source author intended. As explained in more detail below, such ambient conditions models may also have a non-uniform time constant for how stimuli over time affect the viewer's instantaneous adaptation. In other words, the model may attempt to predict changes in a user's perception due to changes in the viewer's ambient conditions.

Figure 5:
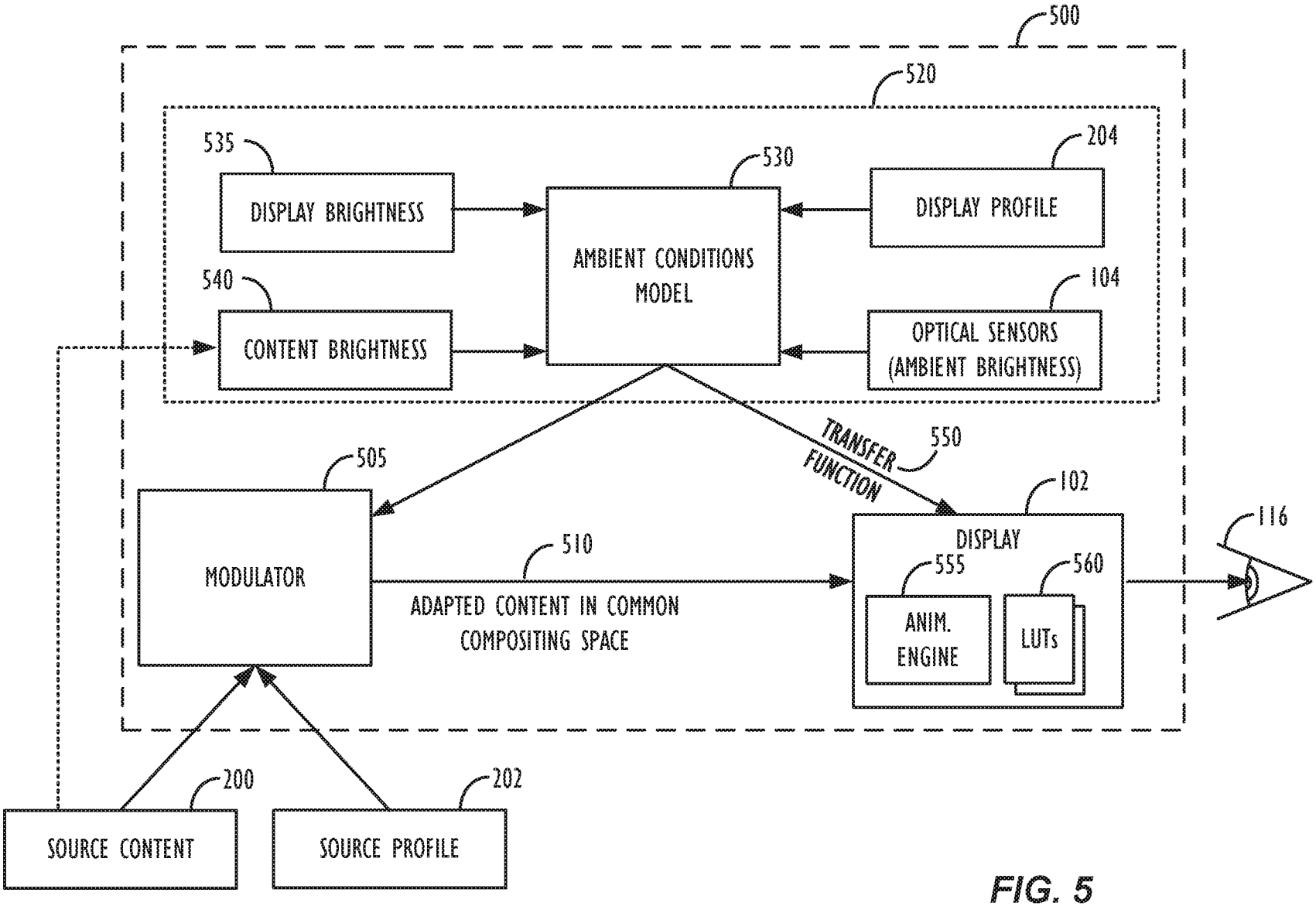
FIG. 5 illustrates a system for performing dynamic display adjustment based on ambient conditions, in accordance with one or more embodiments.

Referring now to FIG. 5, a system 500 for performing dynamic display adjustment is illustrated, in accordance with one or more embodiments. The system depicted in FIG. 5 is similar to that depicted in FIG. 2, with the addition of modulator 505 and ambient conditions model 530 and, in some embodiments, an animation engine 555 in display 102. A given display, e.g., display 102, may be said to have the capability to "modulate" (that is, adapt or adjust to) only a certain percentage of possible surround environments at a given moment in time. For instance, if the environment is much brighter than the display such that the display is reflecting a lot of light at its minimum display output level, then the display may have a relatively high "pedestal" value, and thus, even at its maximum display output level, only be able to modulate a fraction of the ambient lighting conditions.

Modulator 505 may thus be used to apply a transformation warping the source content 100 (e.g., high precision source content) into the user's adapted visual perception of display 102 in a given environment. As described above, warping the original source content signal to the perception of the user of the display and the display's environment may be based, e.g., on the predicted viewing environment conditions received from ambient conditions model 530. For example, the ratio of display 102's diffuse white brightness in nits to the brightness of the user's view beyond display 102, called the surround, also in nits may be used to apply a gamma boost, color saturation correction, or similar algorithm to compensate for the perceptual effect of viewing content in a surround with a different brightness than the surround of source content 200 during capture, editing, or approval. In implementations where modulator 505 applies gamma boost to source content 200, no boost, i.e. a gamma of 1.0, would be applied when display 102's diffuse reference brightness equals the brightness of the surround. Modulator 505 may smoothly increase the gamma boost applied to source content 200 through 1.25 gamma at a 20:1 ratio of diffuse brightness to surround, called a dim surround. Modulator 505 may increase the gamma boost applied to source content 200 to an upper threshold, such as a gamma boost of 1.5 for bright surround adapted content displayed in a very dark surround. Modulator 505 and ambient conditions model 530 may determine the ratio of diffuse white brightness to viewing surround brightness for current ambient light conditions, and apply an appropriate gamma boost to the content. For example, a display device with a diffuse white brightness of 100 nits and a viewing surround with a brightness of five nits corresponds to a display to surround ratio of 20:1. This viewing surround may be classified as a dim surround, causing modulator 505 to apply a 1.25 gamma boost. The increased gamma boost increases the contrast of source content 200, causing it to appear as intended despite the dim surround. The same display device in a very dark environment may be considered a dark surround, causing modulator 505 to apply a 1.5 gamma boost to compensate.

According to some embodiments, the modulator 505 may also apply a content-based transform to the source content in order to adapt it to the display color space (e.g., in instances where the source content itself has indicated a particular gamma boost, color saturation, or the like corresponding to a particular intended viewing environment). Modulator 505 may then transition the content as adapted to the display space according to its own indicators into a common compositing space, such that multiple content items with different intended viewing environments are adapted for a same viewing environment, resulting in the production of an adapted content in common compositing space signal 510. It is to be understood that the description of using one or more LUTs to implement the modifications determined by the ambient conditions model is just one exemplary mechanism that may be employed to control the display's response. For example, tone mapping curves (including local tone mapping curves) and/or other bespoke algorithms may be employed for a given implementation.

As illustrated within dashed line box 520, ambient conditions model 530 may take various factors and source of information into consideration, e.g.: information indicative of ambient light conditions obtained from one more optical sensors 104 (e.g., ambient light sensors); information indicative of the display profile 204's characteristics (e.g., an ICC profile, an amount of static light leakage for the display, an amount of screen reflectiveness, a recording of the display's 'first code different than black,' a characterization of the amount of pixel crosstalk across the various color channels of the display, etc.); the display's brightness 535; and/or the displayed content's brightness 540. The ambient conditions model 530 may then evaluate such information to predict the effect of ambient conditions on the viewer's perception and/or suggest modifications to improve the display device's tone response curve for the viewer's current surround. As discussed previously, ambient conditions model 530 may be used to determine the ratio of diffuse white brightness to the viewing surround brightness.

The result of ambient conditions model 530's evaluation may be used to determine a modified transfer function 550 for the display. The modified transfer function 550 may comprise a modification to the display's white point, black point, and/or overall system gamma, color saturation, or a combination thereof. For reference, "black point" may be defined as the lowest level of light to be used on the display in the current ambient environment, such that the lowest images levels are distinguishable from each other (i.e., not "crushed" to black) in the presence of the current pedestal level (i.e., the sum of reflected and leaked light from the display). "White point" may be defined as the color of light (e.g., as often described in terms of the CIE XYZ color space) that the user, given their current viewing environment, sees as being a pure/neutral white color. In some embodiments, the modifications to the display's transfer function comprise modifications to the system overall gamma. Applying gamma boost to adapt to viewing conditions is one example of an appropriate compensation technique. Other algorithms are described in CIECAM02 and elsewhere.

Next, according to some embodiments, system 500 modifies one or more LUTs 560, such as may be present in display 102, to implement the modified transfer function 550. After modification, LUTs 560 may serve to make the display's transfer function adaptive and "environmentally-aware" of the viewer's current ambient conditions and the content that is being, has been, or will be viewed. (As mentioned above, different mechanisms, i.e., other than LUTs, may also be used to adapt the display's transfer function or gamma boost, e.g., tone mapping curves or other bespoke algorithms designed for a particular implementation.)

As alluded to above, in some embodiments, the modifications to LUTs 560 may be implemented gradually (e.g., over a determined interval of time), via animation engine 555. According to some such embodiments, animation engine 555 may be configured to adjust the LUTs 560 based on the rate at which it is predicted the viewer's vision will adapt to the changes.

In some embodiments, the black level for a given ambient environment is determined, e.g., by using an ambient light sensor 104 or by taking measurements of the actual panel and/or diffuser of the display device. As mentioned above in reference to FIG. 1A, diffuse reflection of ambient light off the surface of the device may add to the intended display values and affect the user's ability to perceive the darkest display levels (a phenomenon also known as "black crush"). In other environments, light levels below a certain brightness threshold will simply not be visible to the viewer. Once this level is determined, the black point may be adjusted accordingly.

In another embodiment, the white point, i.e., the color a user perceives as white for a given ambient environment, may be determined similarly, e.g., by using one or more optical sensors 104 to analyze the lighting and color conditions of the ambient environment. The white point for the display device may then be adapted to be the determined white point from the viewer's surround. Additionally, it is noted that modifications to the white point may be asymmetric between the LUT's Red, Green, and Blue channels, thereby moving the relative RGB mixture, and hence the white point.

In another embodiment, a color appearance model (CAM), such as the CIECAM02 color appearance model, may further inform the ambient conditions model regarding the appropriate amount of gamma boost to apply with the display's modified transfer function. The CAM may, e.g., be based on the brightness and white point of the viewer's surround, as well as the field of view of the display subtended by the viewer's field of vision. In some embodiments, knowledge of the size of the display and the distance between the display and the viewer may also serve as useful inputs to the model. Information about the distance between the display and the user could be retrieved from a front-facing image sensor, such as front-facing camera 104. For example, as discussed previously herein, the brightness and white point of the viewer's surround may be used to determine a ratio of diffuse white brightness to the viewing surround brightness. Based on the determined ratio, a particular gamma boost may be applied. For example, for pitch black ambient environments, an additional gamma boost of about 1.5 imposed by the LUT may be appropriate, whereas a 1.0 gamma boost (i.e., unity, or no boost) may be appropriate for a bright or sun-lit environment. For intermediate surrounds, appropriate gamma boost values to be imposed by the LUT may be interpolated between the values of 1.0 and about 1.5. A more detailed model of surround conditions is provided by the CIECAM02 specification.

In some embodiments, modulator 505 may first adapt source content 200 to its reference environment using specified adaptation algorithms included in source profile 202. For example, RGB based gamma for rec.709 video, as classically applied via a mismatch between content encoding gamma and display 102's decoding response. Once source content 200 is adapted to its reference environment using its specified algorithms, modulator 505 may adapt source content 200 into a shared, system-level viewing environment, or common compositing space, using best practices. The common compositing space may be dynamically changed to match the user's current viewing environment, or held constant. In implementations in which the common compositing space is held constant, modulator 505 may globally adapt all content items in the common compositing space to adapt the fixed common compositing space to the current viewing environment. Any appropriate techniques may be used to adapt source content 200 from its reference environment to the common compositing space, and from the common compositing space to the current viewing environment. This function may be particularly useful where multiple content items from multiple source authors are to be displayed at a time. The unique content adaptations already encoded in each content item may be adjusted without influencing content adaptations applied to other content items. Then, the common compositing space for all content items may be adjusted based on the particular viewing surround for display 102. In the embodiments described immediately above, the LUTs 560 may serve as a useful and efficient place for system 500 to impose these environmentally-aware display transfer function adaptations. In some embodiments, system 500 generates an ICC profile that represents the native response of the display as the true native response of the display divided by the desired system gamma based on the viewing surround. The ICC profile may include fixed "presets" where each preset represents a particular viewing surround and the corresponding environmental adaptations needed for content to be perceived correctly in the particular viewing surround. Modulator 505 may then determine an appropriate preset based on the output from ambient conditions model 530 and apply the corresponding environmental adaptations to source content 200, either directly or to the common compositing space.

Figure 6:
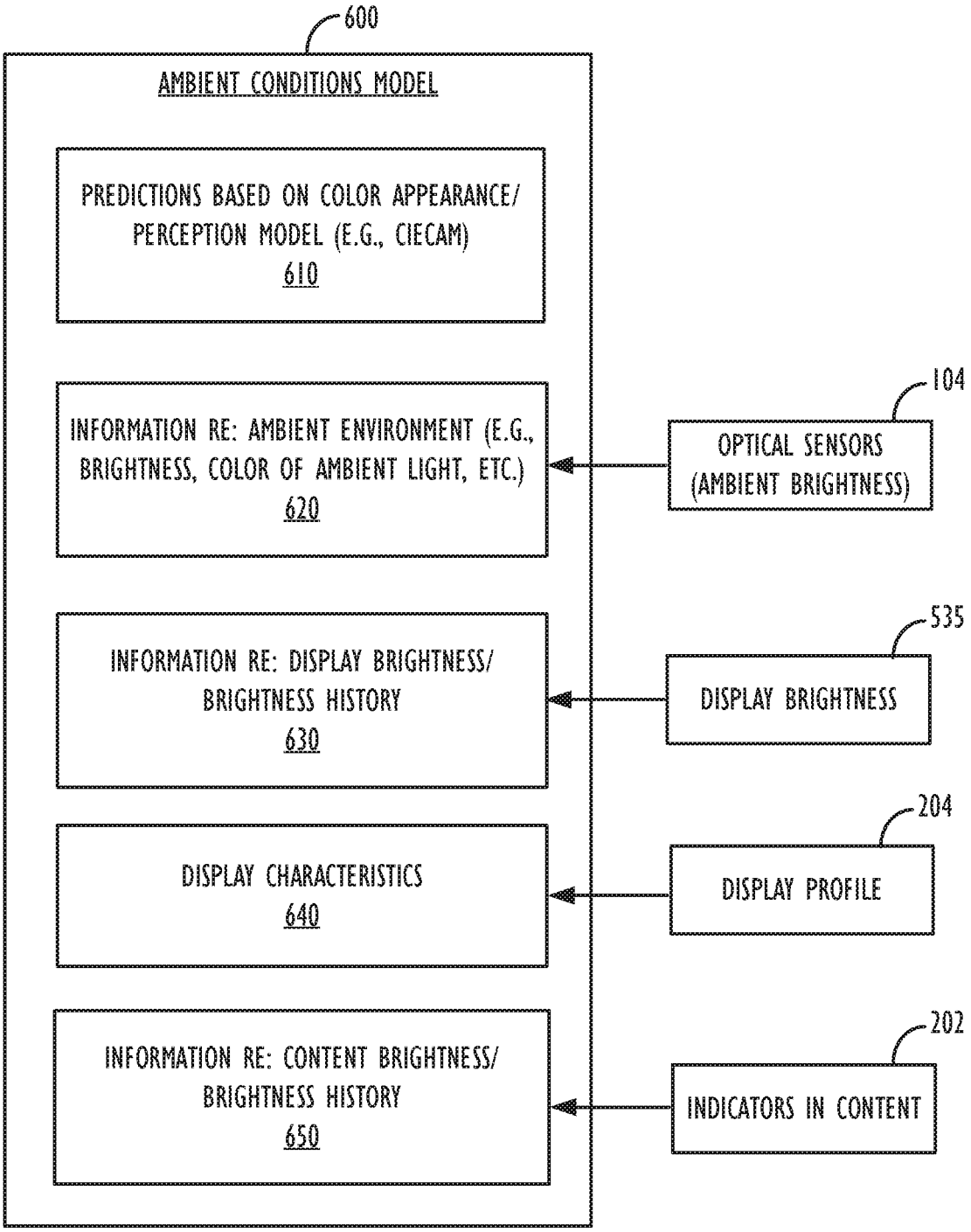
FIG. 6 illustrates a simplified functional block diagram of an ambient conditions model, in accordance with one or more embodiments.

Referring now to FIG. 6, a simplified functional block diagram of an example ambient conditions model 600 is shown. Similar to the ambient conditions model 530 shown in FIG. 5, the ambient conditions model 600 may consider: predictions from a color appearance model 610; information from ambient light sensor(s)/image sensor(s) 620; information regarding the display's current brightness level and/or brightness history 630 (e.g., knowing how bright the display has been and for how long may influence the user's adaptation level); information and characteristics from the display profile 640; and/or information based on historically displayed content/predictions based on upcoming content 650.

Color appearance model 610 may comprise, e.g., the CIECAM02 color appearance model or the CIECAM97s model. Color appearance models may be used to perform chromatic adaptation transforms and/or for calculating mathematical correlates for the six technically defined dimensions of color appearance: brightness (luminance), lightness, colorfulness, chroma, saturation, and hue.

Display characteristics 640 may comprise information from display profile 204 regarding the display device's color space, native display response characteristics or abnormalities, reflectiveness, leakage, or even the type of screen surface used by the display. For example, an "anti-glare" display with a diffuser will "lose" many more black levels at a given (non-zero) ambient light level than a glossy display will.

Historical model 650 may take into account both the instantaneous brightness levels of content and the cumulative brightness of content over a period of time. In other embodiments, the model 650 may also perform an analysis of upcoming content, e.g., to allow the ambient conditions model to begin to adjust a display's transfer function over time, such that it is in a desired state by the time (or within a threshold amount of time) that the upcoming content is displayed to the viewer. The biological/chemical speeds of visual adaptation in humans may also be considered when the ambient conditions model 600 determines how quickly to adjust the display to account for the upcoming content. In some cases, content may itself already be adaptively encoded, e.g., by the source content creator. For example, one or more frames of the content may include a customized transfer function associated with respective frame or frames. In some embodiments, the customized transfer function for a given frame may be based only on the given frame's content, e.g., a brightness level of the given frame. In other embodiments, the customized transfer function for a given frame may be based, at least in part, on at least one of: a brightness level of one or more frames displayed prior to the one or more frames of content; and/or a brightness level of one or more frames displayed after the one or more frames of content. In cases where the content itself has been adaptively encoded, the ambient conditions model 600 may first implement the adaptively encoded adjustments, moving the content into a common compositing space according to content indicators included in source profile 202. Then, ambient conditions model 600 may attempt to further modify the display's transfer function during the display of particular frames of the encoded content, e.g., based on the other various environment factors, e.g., 610/620/630/640, that may have been obtained at the display device.

In some embodiments, a viewer may specify particular adjustments to implement. For example, with reference to FIG. 5, the user may set system 500 in a fixed reference mode, rather than a dynamic surround mode. In the dynamic surround mode, system 500 may periodically determine or update information regarding a viewing surround for display 102, such that modulator 505 and ambient conditions model 530 may determine appropriate adjustments to environmental adaptations for source content 200. In contrast, fixed reference mode causes system 500 to apply only environmental adaptations indicated in source profile 202, without accounting for the current ambient conditions and viewing surround. Fixed reference mode may require display 102 to be viewed in a particular specific reference environment and ambient conditions in order for a user to perceive source content 200 as the source author intended. Modulator 505 may apply the fixed environmental adaptations indicated in source profile 202 regardless of what ambient conditions model 530, optical sensors 104, display brightness 535, and the like indicate about the viewing environment and appropriate environmental adaptations. In these embodiments, ambient conditions model 600 may be used to alert the viewer when the specified adjustments do not appropriately counter the effects of an aspect of the viewing environment. For example, optical sensors 104, display brightness 535, and display profile 204 indicate that the viewing environment and display characteristics cause the current viewing conditions to differ from the reference conditions by more than a threshold amount. Ambient conditions model 600 may alert the viewer that the current viewing conditions differ from the reference environment, and that perception of the content may differ from the source author's intent. For example, the viewer specifies all content should be adapted to a dim surround using a 1.25 gamma boost. When the content is viewed in a dark surround, rather than a dim surround, ambient conditions model 600 may alert the viewer that the specified gamma boost of 1.25 may be too low for the current dark surround, and recommend increasing the gamma boost to 1.5. Similarly, ambient conditions model 600 may be used to alert the viewer when the display is no longer able to apply a gamma or other modulation to appropriately counter the effects of an aspect of the viewing environment. For example, ambient conditions model 600 may be used to alert the viewer that the display cannot apply a large enough gamma boost to compensate for the darkness of the viewing surround and that perception of the content may differ from the source author's intent. Ambient conditions model 600 may perform this function in both a fixed reference mode and a dynamic surround mode.

It should be further mentioned that, many displays have independent: (a) pixel values (e.g., R/G/B pixel values); (b) display colorimetry parameters (e.g., the XYZ definitions of the R/G/B color primaries for the display, as well as the white point and display transfer functions); and/or (c) backlight (or other brightness) modifiers. In order to fully and accurately interpret content brightness, knowledge of the factors (a), (b), and (c) enumerated above for the given display may be used to map the content values into CIE XYZ color space (e.g., scaled according to a desired luminance metric, such as a nit) in order to ensure the modifications implemented by the ambient conditions model will have the desired perception in the current viewing surround. Further, information from ambient light sensor(s)/image sensor(s) 104 may also include information regarding the distance and or eye location of a viewer of the display, which information may be further used to predict how the ambient lighting conditions influence perception of the content.

According to some embodiments, modifications determined by the ambient conditions model 600 may be implemented by changing existing table values (e.g., as stored in one or more calibration LUTs, i.e., tables configured to give the display a 'perfectly' responding tone response curve). Such changes may be performed via looking up the value for the transformed value in the original table, or by modifying the original table 'in place' via a warping technique. For example, the aforementioned black level (and/or white level) adaptation processes may implemented via a warped compression of the values in the table up from black (and/or down from white). In other embodiments, a "re-gamma" and/or a "re-saturation" of the LUTs may be applied in response to the adjustments determined by the ambient conditions model 600.

As is to be understood, the exact manner in which ambient conditions model 600 processes information 610/620/630/640/650 received from the various sources optical sensors 104, display brightness 535, display profile 204, and indicators in content source profile 202, and how it modifies the resultant display response curve, e.g., by modifying LUT values, including how quickly such modifications take place, are up to the particular implementation and desired effects of a given system.

According to some embodiments, the ambient conditions model 600 may be used to consider the various factors described above with reference to FIG. 6 that may have an impact on the viewer's perception at the given moment in time. Then, based on the output of the ambient conditions model 600, an updated display transfer function 550 may be determined for driving the display 102. The display transfer function may be used to convert between the input signal data values and the voltage values that can be used to drive the display to generate a pixel brightness corresponding to the perceptual bin that the transfer function has mapped the input signal data value to at the given moment in time. One goal of the ambient conditions model 600 is to: determine the viewer's current surround; determine what region of the adapted range the content and/or display is modulating; and then map to the transfer function corresponding to that portion of the adapted range, so as to optimally use the display codes (and the bits needed to enumerate them).

Figure 7:
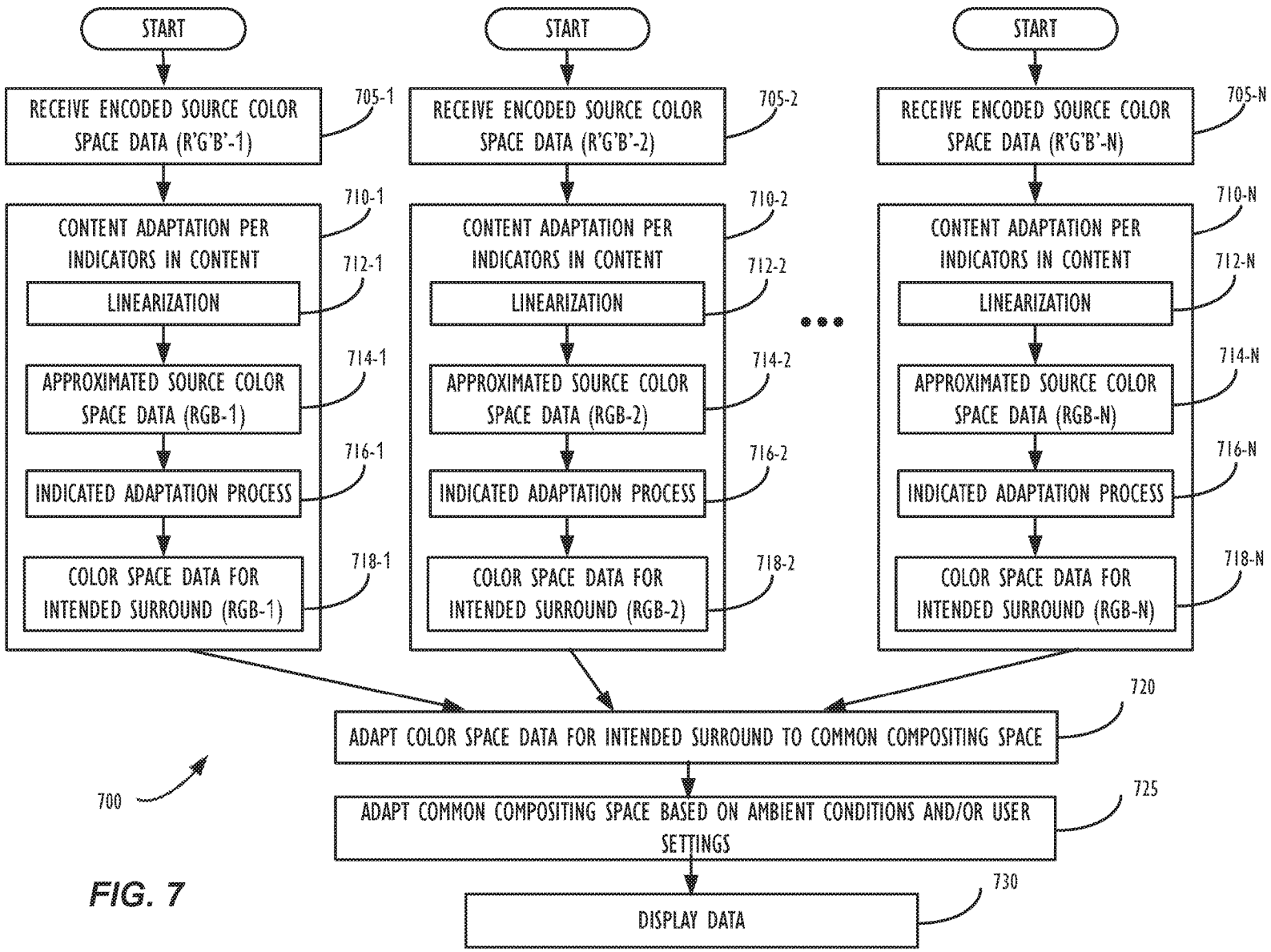
FIG. 7 illustrates, in flowchart form, a process for performing dynamic display adjustment for multiple content items, in accordance with one or more embodiments.

Referring now to FIG. 7, one embodiment of a process 700 for performing dynamic display adjustment is shown in flowchart form. The overall goal of some ambient conditions models may be to understand how the source material will be perceived by a viewer, on the viewer's display, in the viewer's surround, at a given moment in time. First, the display adjustment process may begin by receiving one or more items of encoded display data tied to a source color space (e.g., R'G'B'-1, R'G'B'-2, . . . R'G'B'-N) (Step 705-1, 705-2, . . . 705-N). The apostrophe after a given color channel, such as R', indicates that the information for that color channel is encoded. For example, the viewer wishes to display multiple content items at a time on a display for the viewer's work computer, including several documents and a video. Next the process may begin a unique content adaptation process 710-1, 710-2, . . . 710-N for the corresponding content items R'G'B'-1, R'G'B'-2, . . . R'G'B'-N based on indicators in the content to adapt the content from the source color space to the display color space. In some embodiments, indicators in the content may specify particular adaptation algorithms to be used to adapt the content item from the source color space to the display color space and an intended viewing environment. For example, RGB based gamma for rec.709 video, as classically applied via a mismatch between content encoding gamma and the display's decoding response. As another example, the video the viewer wishes to display was captured in bright surround and intended to be viewed in a dark surround, and so includes gamma boost to accommodate the dark surround of the intended viewing environment. The content adaptation process 710 will adapt the video according to the gamma boost indicated in the content. As part of content adaptation process 710, the process may perform a linearization process to attempt to remove the gamma encoding (Step 712). For example if the data has been encoded with a gamma of (1/2.2), the linearization process may attempt to linearize the data by performing a gamma expansion with a gamma of 2.2. After linearization, the content adaptation process will have a version of the data that is approximately representative of the data as it was in the source color space (RGB-1, RGB-2, . . . RGB-N) (Step 714). At this point, the process may perform an indicated adaptation process to convert the data from the source color space into the display color space (Step 716). In one embodiment, the gamut mapping may use one or more color adaptation matrices. In other embodiments, a 3DLUT may be applied. The content adaptation process according to indicators in the content results in the model having the data in the display device's color space with one or more intended display parameters such as gamma boost or the like according to the source content's preferred or intended viewing environment, such as an industry standard reference environment, (Step 718).

Once the content items are each adapted to their particular reference environments using their own specified algorithms, the display adjustment process may transition the display color space data and intended display parameters corresponding to the preferred viewing environment for each content item (RGB-1, RGB-2, . . . RGB-N) into a common compositing space (Step 720). The common compositing space may be any common compositing space encompassing both the display color space and system-wide display parameters, such as system-wide display parameters for a dim viewing environment, a bright viewing environment, etc. The system-wide display parameters may be a characteristic of the display device. Any appropriate adaptation algorithms may be used to adapt the intended display parameters corresponding to the preferred viewing environment for each content item to the common compositing space and its system-wide display parameters. This ensures that the multiple content items with multiple encoded gamma boosts, saturation levels, and the like may be adapted to a single, system-wide set of display parameters. For example, the video the viewer wishes to display included a gamma boost corresponding to a dark surround, but the documents the viewer wishes to view included a gamma boost corresponding to a bright surround. If the ambient conditions adjustments are applied without first transitioning the content items into a common compositing space, the resultant gamma boost for the video will be different than the resultant gamma boost for the documents, such that the content items are not appropriately adjusted for the ambient conditions. Because the display adjustment process first transitions the intended display parameters for each content item into a common bright surround compositing space with shared display parameters, the ambient conditions adjustments may be applied to the content and result in appropriate adaptations for the current viewing environment. In some embodiments, the common compositing space and system-wide display parameters may be chosen based on the reference environments of one or more content items. For example, if a majority of the content items correspond to a bright surround reference environment, the bright surround reference environment may be chosen as the common compositing space. In some embodiments, the common compositing space may be chosen based on the reference environment of a content item determined to be most important. In some embodiments, the common compositing space may be chosen based on the current viewing environment, reducing the amount of adjustments required to then adapt the content items to the current viewing environment. This feature may be useful for stable viewing environments with infrequent or small changes. For example, the common compositing space and corresponding modified display parameters may be an "average" of recent environmental conditions. Then, in some embodiments, the system-wide display parameters may be adjusted based on ambient conditions, such as based on an ambient conditions model; device characteristics, such as based on display brightness and leakage; and/or according to explicit user settings (Step 725). For example with high dynamic range content, the adjustment of a reference white point may decrease the range of brightness levels dedicated to highlights (the "headroom") in the high dynamic range content. The resulting display data may then be displayed on the viewer's display device based on the modified display parameters (Step 730).

Figure 8:
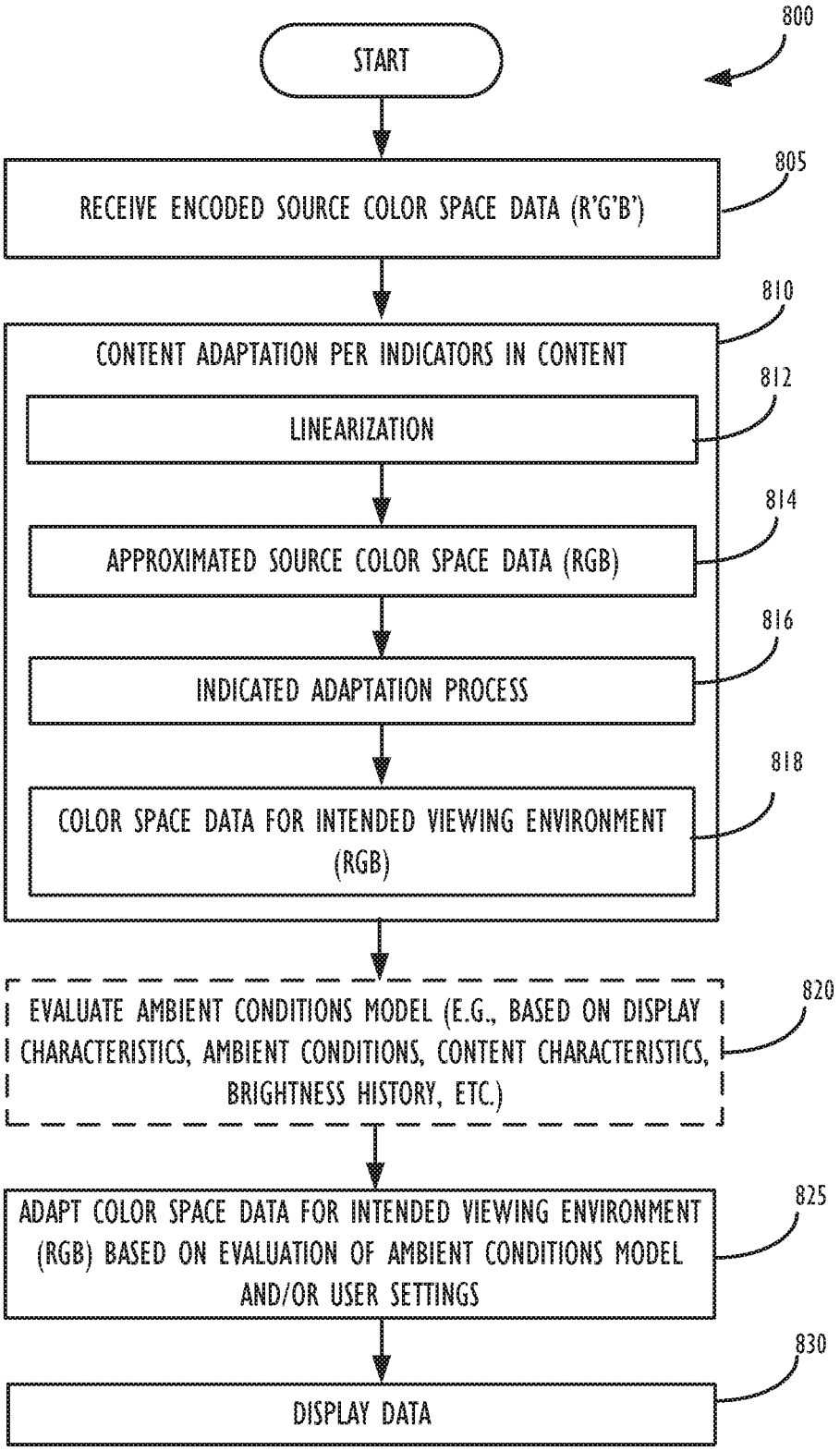
FIG. 8 illustrates, in flowchart form, a process for performing dynamic display adjustment for a single content item, in accordance with one or more embodiments.

Referring now to FIG. 8, another embodiment of a process 800 for performing dynamic display adjustment is shown in flowchart form. First, the display adjustment process may begin by receiving encoded display data tied to a source color space (R'G'B') (Step 805). The apostrophe after a given color channel, such as R', indicates that the information for that color channel is encoded. For example, the viewer wishes to display a single content item, a movie, on a display for the viewer's home theater system. Next the process may begin a content adaptation process 810 based on indicators in the content. For example, the movie the viewer wishes to display was captured in bright surround and intended to be viewed in a dark surround, and so includes an intended display parameter for gamma boost to accommodate the dark surround of the intended viewing environment. The content adaptation process 810 will adapt the video according to the gamma boost indicated in the content. As part of content adaptation process 810, the process may perform a linearization process to attempt to remove the gamma encoding (Step 812). After linearization, the content adaptation process will have a version of the data that is approximately representative of the data as it was in the source color space (RGB) (Step 814). At this point, the process may perform an indicted adaptation process to convert the data from the source color space into the display color space (Step 816). The content adaptation process according to content indicators will result in the model having the data in the display device's color space with an intended display parameter corresponding to the content's intended viewing environment (Step 818).

In instances when only a single content item is to be viewed on the display, the display color space data (RGB) need not be transitioned into a common compositing space with system-wide display parameters. The ambient conditions adjustments or user settings may be applied to the single content item based on its encoded dark surround gamma boost without adversely impacting the resultant gamma for another content item encoded with a bright surround gamma boost, for example. In some embodiments, the display color space data (RGB) is still transitioned to a common compositing space, before being further adapted to the current viewing conditions or user settings. In some embodiments, the display adjustment process evaluates an ambient conditions model, e.g., based on display characteristics, ambient conditions, content characteristics, display brightness history, etc. (Step 820). Then, the system adapts the display color space data (RGB) based on the evaluation of the ambient conditions model or according to user settings (Step 825). The resulting display data may then be displayed on the viewer's display device (Step 830).

Figure 9:
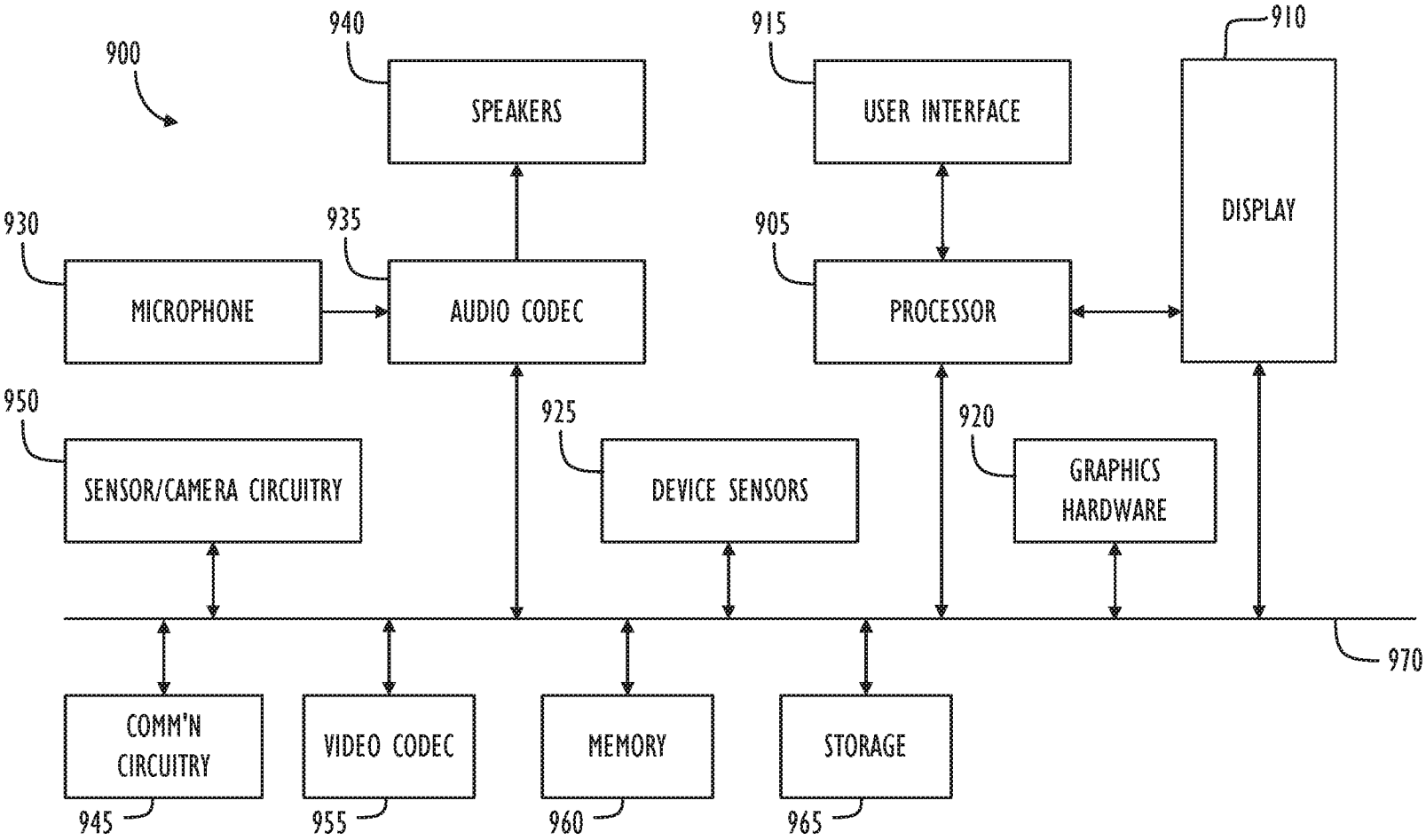
FIG. 9 illustrates a simplified functional block diagram of a device possessing a display, in accordance with one embodiment.

Referring now to FIG. 9, a simplified functional block diagram of a representative electronic device possessing a display is shown, in accordance with some embodiments. Electronic device 900 could be, for example, a mobile telephone, personal media device, HMD, portable camera, or a tablet, notebook or desktop computer system. As shown, electronic device 900 may include processor 905, display 910, user interface 915, graphics hardware 920, device sensors 925 (e.g., proximity sensor/ambient light sensor, accelerometer and/or gyroscope), microphone 930, audio codec(s) 935, speaker(s) 940, communications circuitry 945, image sensor/camera circuitry 950, which may, e.g., comprise multiple camera units/optical sensors having different characteristics (as well as camera units that are housed outside of, but in electronic communication with, device 900), video codec(s) 955, memory 960, storage 965, and communications bus 970.

Processor 905 may execute instructions necessary to carry out or control the operation of many functions performed by device 900 (e.g., such as the generation and/or processing of signals in accordance with the various embodiments described herein). Processor 905 may, for instance, drive display 910 and receive user input from user interface 915. User interface 915 can take a variety of forms, such as a button, keypad, dial, a click wheel, keyboard, display screen and/or a touch screen. User interface 915 could, for example, be the conduit through which a user may view a captured image or video stream and/or indicate particular frame(s) that the user would like to have played/paused, etc., or have particular adjustments applied to (e.g., by clicking on a physical or virtual button at the moment the desired frame is being displayed on the device's display screen).

In one embodiment, display 910 may display a video stream as it is captured, while processor 905 and/or graphics hardware 920 evaluate an ambient conditions model to determine modifications to the display's transfer function or gamma boost, optionally storing the video stream in memory 960 and/or storage 965. Processor 905 may be a system-on-chip such as those found in mobile devices and include one or more dedicated graphics processing units (GPUs). Processor 905 may be based on reduced instruction-set computer (RISC) or complex instruction-set computer (CISC) architectures or any other suitable architecture and may include one or more processing cores. Graphics hardware 920 may be special purpose computational hardware for processing graphics and/or assisting processor 905 perform computational tasks. In one embodiment, graphics hardware 920 may include one or more programmable graphics processing units (GPUs).

Image sensor/camera circuitry 950 may comprise one or more camera units configured to capture images, e.g., images which indicate ambient lighting conditions in the viewing environment and may have an effect on the output of the ambient conditions model, e.g., in accordance with this disclosure. Output from image sensor/camera circuitry 950 may be processed, at least in part, by video codec(s) 955 and/or processor 905 and/or graphics hardware 920, and/or a dedicated image processing unit incorporated within circuitry 950. Images so captured may be stored in memory 960 and/or storage 965. Memory 960 may include one or more different types of media used by processor 905, graphics hardware 920, and image sensor/camera circuitry 950 to perform device functions. For example, memory 960 may include memory cache, read-only memory (ROM), and/or random access memory (RAM).

Storage 965 may store media (e.g., audio, image and video files), computer program instructions or software, preference information, device profile information, and any other suitable data. Storage 965 may include one more non-transitory storage mediums including, for example, magnetic disks (fixed, floppy, and removable) and tape, optical media such as CD-ROMs and digital video disks (DVDs), and semiconductor memory devices such as Electrically Programmable Read-Only Memory (EPROM), and Electrically Erasable Programmable Read-Only Memory (EEPROM). Memory 960 and storage 965 may be used to retain computer program instructions or code organized into one or more modules and written in any desired computer programming language. When executed by, for example, processor 905, such computer program code may implement one or more of the methods described herein.

The foregoing description of preferred and other embodiments is not intended to limit or restrict the scope or applicability of the inventive concepts conceived of by the Applicants.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method of displaying content on a display device, comprising:

receiving data indicative of a characteristic of a display device;

receiving data indicative of an intended color space adaptation technique and an intended display parameter for a content item;

performing a simultaneous contrast adaptation on the content item based on the data indicative of the intended color space adaptation technique, such that an adapted content item is mapped to a display color space and the intended display parameter;

modifying the intended display parameter of the adapted content item based on the characteristic of the display device to obtain a modified display parameter; and displaying the adapted content item on the display device based on the modified display parameter.

2. The method of claim 1, wherein the intended display parameter is based, at least in part, on at least one of: a capture environment for the content item; an editing environment for the content item; and an intended viewing environment for the content item.

3. The method of claim 1, wherein the modified display parameter is associated with a viewing environment of the display device.

4. The method of claim 1, wherein the modified display parameter is associated with a common compositing space, the method further comprising adjusting the modified display parameter associated with the common compositing space based on a user setting.

5. The method of claim 1, wherein the modified display parameter is associated with a common compositing space, the method further comprising:

receiving data indicative of ambient light conditions; and adjusting the modified display parameter associated with the common compositing space based on the data indicative of ambient light conditions.

6. The method of claim 5, wherein the data indicative of ambient light conditions is received from an optical sensor, and wherein the optical sensor comprises one or more of the following: an ambient light sensor, an image sensor, and a video camera.

7. The method of claim 5, wherein the data indicative of ambient light conditions comprises data indicative of at least one of: ambient light conditions from an image sensor facing in a direction of a viewer of the display device; or ambient light conditions from an image sensor facing away from a viewer of the display device.

8. The method of claim 5, further comprising evaluating an ambient conditions model based at least in part on the data indicative of ambient light conditions and the data indicative of the characteristic of the display device, wherein adjusting the modified display parameter associated with the common compositing space is further based on the evaluation of the ambient conditions model.

9. The method of claim 8, wherein adjusting the modified display parameter associated with the common compositing space further comprises determining an adjustment to a black point, white point, or a combination thereof, of the display device.

10. A non-transitory program storage device comprising instructions stored thereon to cause one or more processors to:

receive a first content item encoded with a first intended color space adaptation technique for a first intended viewing environment;

receive a second content item encoded with a second intended color space adaptation technique for a second intended viewing environment;

adapt the first content item to a display color space and the first intended viewing environment based on the first intended color space adaptation technique;

adapt the second content item to the display color space and the second intended viewing environment based on the second intended color space adaptation technique;

transition the adapted first and second content items to a display viewing environment; and cause the adapted first and second content items transitioned to the display viewing environment to be displayed on a display device.

11. The non-transitory program storage device of claim 10, further comprising instructions to cause the processors to apply a system adaptation to the adapted first and second content items transitioned to the display viewing environment.

12. The non-transitory program storage device of claim 11, further comprising instructions to cause the processors to adjust the system adaptation based on a user setting.

13. The non-transitory program storage device of claim 11, further comprising instructions to cause the processors to adjust the system adaptation based on ambient light conditions surrounding the display device.

14. The non-transitory program storage device of claim 13, wherein the instructions to adjust the system adaptation based on ambient light conditions comprise instructions to cause the processors to:

receive data indicative of a characteristic of the display device;

receive data indicative of the ambient light conditions; and evaluate an ambient conditions model based, at least in part, on the data indicative of the characteristic of the display device and the data indicative of the ambient light conditions, wherein the instructions to evaluate the ambient conditions model comprise instructions to determine an adjustment to the system adaptation.

15. The non-transitory program storage device of claim 14, wherein the instructions to evaluate an ambient conditions model further comprise instructions to cause the processors to determine one or more adjustments to a black point, white point, or a combination thereof, of the display device.

16. A device, comprising:

a memory;

a display, wherein the display is characterized by a characteristic; and one or more processors operatively coupled to the memory, wherein the processors are configured to execute instructions causing the processors to:

receive data indicative of a preferred color space adaptation technique and an intended display parameter for a content item;

perform a simultaneous contrast adaptation on the content item based on the preferred color space adaptation technique, such that the adapted content item is mapped to a display color space and the intended display parameter;

modify the intended display parameter based at least in part on the characteristic of the display to obtain a modified display parameter; and cause the adapted content item to be displayed on the display according to the modified display parameter.

17. The device of claim 16, wherein the intended display parameter is based, at least in part, on at least one of: a capture environment for the content item; an editing environment for the content item; and an intended viewing environment for the content item.

18. The device of claim 16, wherein the processors are further configured to execute instructions causing the processors to:

obtain data indicative of ambient light conditions;

adjust the modified display parameter based on the data indicative of ambient light conditions; and cause the adapted content item to be displayed on the display according to the adjusted and modified display parameter.

19. The device of claim 18, wherein the instructions to adjust the modified display parameter further comprise instructions causing the processors to evaluate an ambient conditions model based on the data indicative of ambient light conditions.

20. The device of claim 18, wherein the instructions to adjust the modified display parameter further comprise instructions causing the processors to determine one or more adjustments to a black point, a white point, or a combination thereof, of the display.

21. The device of claim 16, wherein the instructions to adjust the modified display parameter further comprise instructions causing the processors to adjust the modified display parameter based on a user setting.

22. The device of claim 16, wherein the content item is a first content item, wherein the preferred color space adaptation technique is a first preferred color space adaptation technique, wherein the intended display parameter is a first intended display parameter, wherein the simultaneous contrast adaptation is a first simultaneous contrast adaptation, and wherein the processors are further configured to execute instructions causing the processors to:

receive data indicative of a second preferred color space adaptation technique and a second intended display parameter for a second content item;

perform a second simultaneous contrast adaptation on the second content item based on the second preferred color space adaptation technique, such that an adapted second content item is mapped to the display color space and the second intended display parameter;

modify the first and second intended display parameters based at least in part on the characteristic of the display to obtain the modified display parameter; and cause the adapted first and second content items to be displayed on the display according to the modified display parameter.

23. A non-transitory program storage device comprising instructions stored thereon to cause one or more processors to:

receive data indicative of a preferred color space adaptation technique and an intended display parameter for a content item;

perform a simultaneous contrast adaptation on the content item based on the preferred color space adaptation technique, such that the adapted content item is mapped to a display color space and the intended display parameter;

modify the intended display parameter based at least in part on the characteristic of the display to obtain a modified display parameter; and cause the adapted content item to be displayed on the display according to the modified display parameter.

24. The non-transitory program storage device of claim 23, wherein the intended display parameter is based, at least in part, on at least one of: a capture environment for the content item; an editing environment for the content item; and an intended viewing environment for the content item.

25. The non-transitory program storage device of claim 23, further comprising instructions to cause the processors to:

obtain data indicative of ambient light conditions;

adjust the modified display parameter based on the data indicative of ambient light conditions; and cause the adapted content item to be displayed on the display according to the adjusted and modified display parameter.

26. The non-transitory program storage device of claim 25, wherein the instructions to adjust the modified display parameter further comprise instructions causing the processors to evaluate an ambient conditions model based on the data indicative of ambient light conditions.

27. The non-transitory program storage device of claim 25, wherein the instructions to adjust the modified display parameter further comprise instructions causing the processors to determine one or more adjustments to a black point, a white point, or a combination thereof, of the display.

28. The non-transitory program storage device of claim 23, wherein the instructions to adjust the modified display parameter further comprise instructions causing the processors to adjust the modified display parameter based on a user setting.

29. The non-transitory program storage device of claim 23, wherein the content item is a first content item, wherein the preferred color space adaptation technique is a first preferred color space adaptation technique, wherein the intended display parameter is a first intended display parameter, wherein the simultaneous contrast adaptation is a first simultaneous contrast adaptation, and wherein the non-transitory program storage device further comprises instructions to cause the processors to:

receive data indicative of a second preferred color space adaptation technique and a second intended display parameter for a second content item;

perform a second simultaneous contrast adaptation on the second content item based on the second preferred color space adaptation technique, such that an adapted second content item is mapped to the display color space and the second intended display parameter;

modify the first and second intended display parameters based at least in part on the characteristic of the display to obtain the modified display parameter; and cause the adapted first and second content items to be displayed on the display according to the modified display parameter.

30. A device, comprising:

a non-transitory program storage device; and one or more processors operatively coupled to the non-transitory program storage device, wherein the processors are configured to execute instructions causing the processors to:

receive a first content item encoded with a first intended color space adaptation technique for a first intended viewing environment;

receive a second content item encoded with a second intended color space adaptation technique for a second intended viewing environment;

adapt the first content item to a display color space and the first intended viewing environment based on the first intended color space adaptation technique;

adapt the second content item to the display color space and the second intended viewing environment based on the second intended color space adaptation technique;

transition the adapted first and second content items to a display viewing environment; and cause the adapted first and second content items transitioned to the display viewing environment to be displayed on a display device.

31. The device of claim 30, wherein the processors are further configured to execute instructions causing the processors to apply a system adaptation to the adapted first and second content items transitioned to the display viewing environment.

32. The device of claim 31, wherein the processors are further configured to execute instructions causing the processors to adjust the system adaptation based on a user setting.

33. The device of claim 31, wherein the processors are further configured to execute instructions causing the processors to adjust the system adaptation based on ambient light conditions surrounding the display device.

34. The device of claim 33, wherein the instructions to adjust the system adaptation based on ambient light conditions further comprise instructions causing the processors to:

receive data indicative of a characteristic of the display device;

receive data indicative of the ambient light conditions; and evaluate an ambient conditions model based, at least in part, on the data indicative of the characteristic of the display device and the data indicative of the ambient light conditions, wherein the instructions to evaluate the ambient conditions model comprise instructions to determine an adjustment to the system adaptation.

35. The device of claim 34, wherein the instructions to evaluate an ambient conditions model further comprise instructions causing the processors to determine one or more adjustments to a black point, white point, or a combination thereof, of the display device.

36. A method, comprising:

receiving a first content item encoded with a first intended color space adaptation technique for a first intended viewing environment;

receiving a second content item encoded with a second intended color space adaptation technique for a second intended viewing environment;

adapting the first content item to a display color space and the first intended viewing environment based on the first intended color space adaptation technique;

adapting the second content item to the display color space and the second intended viewing environment based on the second intended color space adaptation technique;

transitioning the adapted first and second content items to a display viewing environment; and causing the adapted first and second content items transitioned to the display viewing environment to be displayed on a display device.

37. The method of claim 36, further comprising applying a system adaptation to the adapted first and second content items transitioned to the display viewing environment.

38. The method of claim 37, further comprising adjusting the system adaptation based on a user setting.

39. The method of claim 37, further comprising adjusting the system adaptation based on ambient light conditions surrounding the display device.

40. The method of claim 39, wherein adjusting the system adaptation based on ambient light conditions comprises:

receiving data indicative of a characteristic of the display device;

receiving data indicative of the ambient light conditions; and evaluating an ambient conditions model based, at least in part, on the data indicative of the characteristic of the display device and the data indicative of the ambient light conditions, wherein evaluating the ambient conditions model comprises determining an adjustment to the system adaptation.

41. The method of claim 40, wherein evaluating an ambient conditions model further comprises determining one or more adjustments to a black point, white point, or a combination thereof, of the display device.

* * * * *